US005133386A

United States Patent [19]

Magee

[11] Patent Number: 5,133,386

[45] Date of Patent: Jul. 28, 1992

[54] BALANCED, PRESSURE-FLOW-COMPENSATED, SINGLE-STAGE SERVOVALVE

[76] Inventor: Garth L. Magee, 4448 El Segundo Blvd., #234, Hawthorne, Calif. 90250

[21] Appl. No.: 560,211

[22] Filed: Jul. 19, 1990

Related U.S. Application Data

[63] Continuation-in-part of Ser. No. 341,930, Apr. 21, 1989, abandoned.

[51] Int. Cl.[5] ..... F15B 13/044

[52] U.S. Cl. ..... 137/625.65; 137/625.2; 137/625.27; 137/625.44; 251/281; 251/282

[58] Field of Search ..... 137/625.2, 625.65, 625.27, 137/625.44; 251/281, 282

[56] References Cited

U.S. PATENT DOCUMENTS

| | | | |
|---|---|---|---|
| 2,739,613 | 3/1956 | Kulikoff . | |
| 2,839,079 | 6/1958 | Holmes . | |
| 2,912,010 | 11/1959 | Evans et al. | 251/282 X |
| 2,969,775 | 1/1961 | Thelen . | |
| 3,457,955 | 7/1969 | Kleiner et al. | 137/625.44 |
| 4,111,230 | 9/1978 | Stampfli | 137/625.5 |
| 4,417,823 | 11/1983 | Drevet | 384/115 |

FOREIGN PATENT DOCUMENTS

| | | | |
|---|---|---|---|
| 1229952 | 9/1960 | France | 137/625.2 |

*Primary Examiner*—Gerald A. Michalsky

[57] ABSTRACT

A hydraulic servovalve is controlled electrically through electromagnetic means. Electrical currents applied to force motors determine the relative position of a single, displaceable control assembly within the valve. Displacive movement of the control assembly changes, in reciprocal proportion, the inlet and outlet flow-metering clearances in each of the chambers of this open-passage type valve. The position of the control assembly determines the inlet and outlet flows within, and, therefore, the net flow through, each chamber. Moreover, since the chambers are each connected (either directly, or through a flow-impeding orifice) to one of the control ports, the position of the control assembly thereby determines the control flow delivered by the valve. Generally, both hydrostatic and hydrodynamic forces within the valve are balanced against corresponding forces, all acting upon the control assembly. However, any internal unbalanced hydrodynamic forces—which arise in proportion to control flow—are compensated by opposing hydrostatic forces, creating a naturally stable servovalve over a wide range of operating conditions.

47 Claims, 8 Drawing Sheets

BALANCED, PRESSURE-FLOW-COMPENSATED, SINGLE-STAGE SERVOVALVE

This is a continuation-in-part of copending application Ser. No. 07/341,930 filed on Apr. 21, 1989, now abandoned.

BACKGROUND OF THE INVENTION

1. Field of the Invention

The invention relates to fluid-flow-control valves, and specifically to a pressure-flow-compensated four-way servovalve, having a single stage with a balanced control member, for use in hydraulic systems.

2. Description of Prior Art

Heretofore, four-way hydraulic valves having a single balanced moving member with multiple disks connected by an axial shaft, and having annular rings interspersed between the disks to form thin clearance passages for metering radial flows across the disks, had been naturally unstable; normally, the moving member sought an extreme—rather than central—axial position. Any nonsymmetrical flows within the valve—normally producing control flow between the control ports of the valve—created directly proportional, unbalanced hydrodynamic forces, oriented both axially and unidirectionally upon the moving member. In order to properly regulate flows through the valve, the moving member had to be restrained against displacements caused by these destabilizing forces. For this reason, the moving member was either actively positioned, or passively restrained, against destabilizing movements from a balanced position, over its entire range of axial displacement.

External linkages, relatively stiff springs, and powerful motors were used to position the moving member against the substantial unbalanced forces present in this type of valve. Counterchecking springs counterposed against the unbalanced hydrodynamic forces were often used to restrain the moving member from decentering and destabilizing displacements; the greater the fluid-power output capacity of the valve, the larger were the internal unbalanced forces, and the stiffer were the springs needed to restrain the moving member. However, in order to ensure accurate valve operation, the springs had to be carefully matched so that the moving member would be centered within its range of displacement under null operating conditions: zero control flow between, and zero load pressure drop across, the control ports. The more accurately the springs were matched and counterbalanced upon the moving member—when centered within the valve—the smaller was the applied null bias force necessary to restore the valve to the null condition. However, the very narrow range of displacement available in this type of valve severely reduced the acceptable error in centering the moving member at null. In order to achieve the necessary centering accuracy, the springs had to be precisely matched. Moreover, minimizing the null bias force became even more difficult as valve power output capacity increased: stiffer springs needed to counter the larger unbalanced forces were more difficult to match. Furthermore, since the springs opposed not only displacement of the moving member by unbalanced forces, but also its displacement by forces applied to actuate the valve, increasing their stiffness necessitated the use of more powerful force motors. And while the use of stiffer springs, together, with more powerful motors, could augment the fluid-power output capacity of the valve, more powerful input signals were then needed to control the more powerful motors. Such motors were usually large and thus more easily located externally to the valve, being connected to its moving member by a mechanical linkage. However, the use of an external mechanical linkage, together with the external seals required to prevent fluid leakage from the valve, often proved awkward for use in servomechanisms. For these reasons, and since internal motors usually proved too weak to provide the applied force necessary to control the position of the moving member, this type of valve has not been widely used. If the unbalanced forces could be eliminated, obviating the need for restraining springs, smaller motors could be used to position the moving member without loss of fluid-power output capacity from the valve—thereby creating an improved balanced single-stage servovalve for use in electrohydraulic servomechanisms.

SUMMARY OF THE INVENTION

The invention compensates internal unbalanced forces, creating a balanced single-stage servovalve in which the moving member is stable—naturally seeking a balanced position within its range of displacement—over a wide range of operating conditions. Compensating the unbalanced hydrodynamic forces with proportional hydrostatic forces, the invention obviates the need for springs to maintain the stability of the moving member. Without springs to restrain its movement, and with only these countervailing forces acting upon it, the moving member is more easily controlled, with a relatively small applied force, over a wider range of displacement. Since increasing the ratio of stable displacement range to total displacement range of the moving member in this type of valve increases the ratio of loaded flow (control flow under conditions of a load-pressure drop) to total valve flow (total flow supplied to the valve), or the ratio of load-pressure drop to total valve-pressure drop—or both—the invention yields greater fluid-power output capacity. In addition, since the applied force needed to position the moving member is relatively small, it can be applied without the use of a mechanical linkage, using, instead, internal electromagnetic force motors. Other advantages of the invention include improved performance and expanded design flexibility.

Performance and reliability are enhanced in the invention. Two measures of performance are directly improved by reduced internal friction: threshold—the valve input (usually current) required to produce a change in valve output (either control flow or load pressure); and hysteresis—the cyclic change in valve input required to produce a regular valve output, when the input is cycled slowly enough to exclude dynamic effects. Since external linkages are unnecessary in the invention, no seals are used which could inhibit the free movement of the moving member. Instead, internal guides, lubricated by hydraulic fluid, provide the only contact with the moving member. The moving member slides in the guides; the surface areas in contact are small, minimizing friction and, therefore, reducing both threshold and hysteresis. In addition, eliminating springs and external linkages attached to the moving member reduces its inertia, thereby extending the dynamic range of the invention. Finally, reliability is improved in the invention through the use of thin passages—instead of the sharp-edged orifices used in conventional sliding spool valves—as the principal means to meter internal flow. The thin passages are more resistant to erosion than are the spool valves' sharp edges. (Erosion of the edges in spool valves degrades the valves' performance, limiting their useful life.) Furthermore, the effects of any existing erosion in the invention are less consequential to valve performance and, as a result, to valve life.

Greater static and dynamic accuracies may be attained using the invention, since flow gain (the slope of the control-flow-versus-valve-input curve) is improved: flow gain is less sensitive to changes in operating conditions in this type of open-passage valve. Flow gain is more constant since the invention has a more linear loaded-flow characteristic than that of the flow-control spool valve. This difference in linearity of the loaded-flow characteristic between the two types of valves stems from differences in the type of orifice used to regulate internal flows. The flow through sharp-edged orifices—present in the conventional sliding spool valve—is proportional to the square root of the difference in pressure across the orifice. This square-law relation yields nonlinear pressure-flow relationships in the common flow-control spool valve, in which flow gain typically decreases monotonically with increasing load pressure. However, flow through the thin passages of the invention is directly proportional to the difference in pressure across each passage: a linear relation. When properly configured as a flow-control valve, the invention yields pressure-flow relationships which are generally more linear within the flow limit: the load condition where control flow ceases to increase with increasing valve input. Since constant flow gain can be obtained from a linear loaded-flow characteristic, flow gain is more sustained in the invention, even under loaded conditions. Equally important, the open-passage design maintains relatively constant flow gain through the null region: the range of valve input near null where the effects of imperfect lap and internal leakage in the output stage of the conventional spool valve can cause dramatic variation in flow gain. Variations in flow gain in the null region can cause system instability, or, in response to small input signals, positioning inaccuracy and poor dynamic response. Thus, by maintaining flow gain generally constant through null, the invention not only offers greater system stability, but provides greater static accuracy for unloaded conditions, while by sustaining flow gain under loaded conditions, the invention provides greater dynamic accuracy.

In addition to improved performance, the invention offers a wide range of operating characteristics, and is thus able to meet the control requirements of a variety of servomechanisms. The basic invention may be customized for specific applications simply by changing the relative proportions of the internal forces balanced upon the moving member. The internal forces are easily altered through slight changes in the relative dimensions of the internal valve components. Dimensional changes can, for example, be used to augment the compensative hydrostatic forces, in order to create greater pressure-control characteristics—and decreased flow-control characteristics—in the valve. In this configuration, the compensative hydrostatic forces would be proportional not only to flow between the control ports, but to the difference in pressure between the control ports: the greater the control flow, or the greater the load-pressure drop, the greater the compensatory forces.

The invention also offers greater fluid-power output capacity. By compensating the internal unbalanced forces, the invention may control, in a single stage, fluid power which normally could be controlled only by using a two-stage spool valve. Moreover, the invention may be scaled larger to increase its fluid-power output capacity still further. Potentially, the invention could be used in very high power applications, replacing either the first two stages, or all three stages, of the conventional three-stage spool valve.

While many various embodiments of the invention are described herein, all relate to one of two basic configurations: the translational embodiment, in which the moving member is translated along its central axis, and the rotary embodiment, in which the moving member is instead rotated about its central axis. Both embodiments have balanced moving members, the internal unbalanced hydrodynamic forces being offset by hydrostatic forces. In the translational embodiment, countervailing forces act upon the moving member; in the rotary embodiment, countervailing moments of force act upon the moving member. Many other features may be incorporated into either of these embodiments without detracting from the essential characteristics and aforementioned advantages of the invention.

It is therefore a general object of the present invention to provide an improved single-stage servovalve.

Another object is to provide an improved balanced single-stage valve having hydrostatic means to compensate for the unbalanced hydrodynamic forces which act upon its moving member.

Another object is to provide an improved balanced single-stage valve having hydrostatic means to restrain displacement of its moving member from a balanced position.

Another object is to provide an improved balanced single-stage valve requiring no springs or external linkages to stabilize the position of its moving member.

Another object is to provide an improved balanced single-stage servovalve having non-contacting means, such as electromagnetic force motors—both responsive to electrical signals and contributing minimal mass to the moving member—to control the position of its moving member.

Another object is to provide an improved balanced single-stage servovalve capable of a wide range of flow-pressure operating characteristics through minor changes in the relative size of its internal components.

Another object is to provide an improved balanced single-stage servovalve having increased static accuracy and stability in the null region.

Another object is to provide an improved balanced single-stage servovalve having increased dynamic accuracy under loaded conditions.

Another object is to provide an improved balanced single-stage servovalve having a single internal moving member which contacts no seals, thus minimizing friction and, therefore, valve threshold and hysteresis.

Another object is to provide an improved balanced single-stage servovalve having increased dynamic range through both reduced inertia and reduced stroke of its moving member.

Another object is to provide an improved balanced single-stage valve having increased reliability through greater resistance to erosion and its debilitating effects on performance.

Another object is to provide an improved balanced single-stage valve with greater fluid-power output capacity.

Another object is to provide a balanced single-stage servovalve suitable for use as an improved primary stage, or stages, in high-power spool valves.

Other objects and advantages of the invention will become apparent from a consideration of the figures and ensuing description.

LIST OF THE REFERENCE NUMERALS

Preferred Embodiment: Translational Configuration

Figure 1:
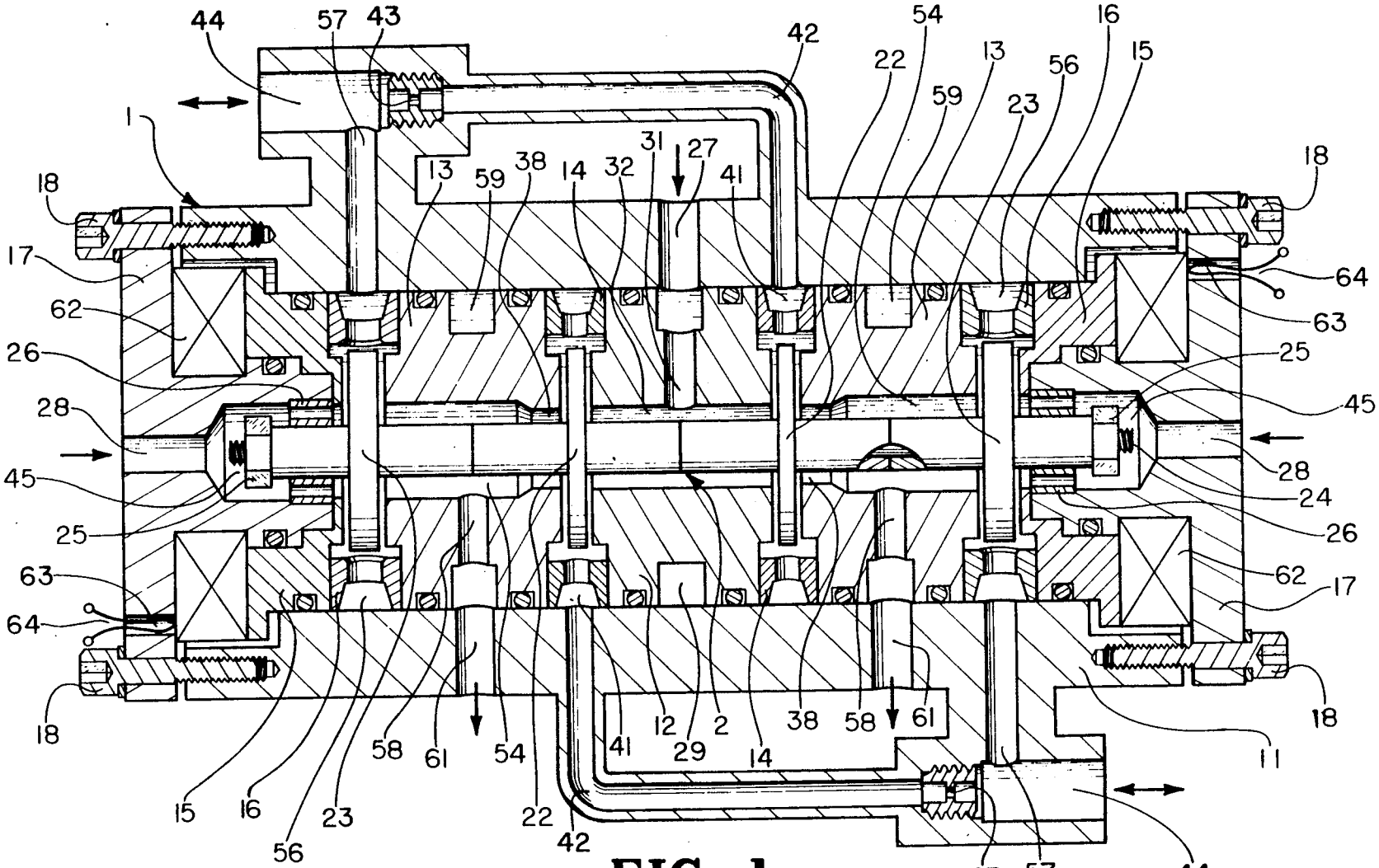
FIG. 1 shows an interior view of the preferred embodiment of the invention. Except for the single moveable assembly, all valve components are shown in full section. The moveable assembly is shown in partial section, at a junction between two of its four major elements, revealing the interior shaft passing through the assembly.

1 balanced, pressure-flow-compensated, single-stage valve
2 control assembly
11 housing
12 inner spool
13 outer spools (2)
14 compensatory rings (2)
15 end spools (2)
16 primary rings (2)
17 end caps (2)
18 cap screws (4 are shown)
19 spool O-ring seals
21 end-cap O-ring seals (2)
22 compensatory flanges (2)
23 primary flanges (2)
24 shaft
25 lock nuts (2)
26 guides (2)central
27 inlet port
28 end-cap inlet ports (2)
29 inlet chamber
31 inlet passage
32 inner spool bore
33 compensatory inlet clearances (2)
34 compensatory inlet sills (2)
35 compensatory chambers (2)
36 compensatory outlet clearances (2)
37 compensatory outlet sills (2)
38 outer spool bores (2)
39 compensatory ring holes (4 are shown)
41 compensatory ring cavities (2)
42 compensatory control passages (2)
43 sharp-edged orifices (2)
44 control ports (2)
45 end-cap counterbores (2)
46 guide bypass holes (4 are shown)
47 end-spool bores (2)
48 primary inlet clearances (2)
49 primary inlet sills (2)
51 primary chambers (2)
52 primary outlet clearances (2)
53 primary outlet sills (2)
54 outer spool counterbores (2)
55 primary ring holes (4 are shown)
56 primary ring cavities (2)
57 primary control passages (2)
58 outlet passages (2)
59 outlet chambers (2)
61 outlet ports (2)
62 solenoidal coils (2)
63 access holes (2)
64 hookup wires (2)

65 pump
66 fluid reservoir
67 double-acting, double-end rod cylinder
101 compressive springs (2)

Alternative Embodiment: Rotary Configuration

3 balanced, pressure-flow-compensated, single-stage valve
4 control assembly
68 upper plate
69 lower plate
71 shaft
72 primary fins (2)
73 compensatory fins (2)
74 primary inlet sills (1 of 2 is shown)
75 primary outlet sills (1 of 2 is shown)
76 compensatory inlet sills (1 of 2 is shown)
77 compensatory outlet sills (1 of 2 is shown)
78 primary chambers (2)
79 compensatory chambers (2)
81 bearing surfaces (1 of 2 is shown)
82 primary inlet ports (2)
83 compensatory inlet ports (2)
84 primary inlet clearances (1 of 2 is shown)
85 compensatory inlet clearances (1 of 2 is shown)
86 primary chamber ports (2)
87 primary outlet ports (2)
88 primary outlet clearances (1 of 2 is shown)
89 compensatory chamber ports (2)
90 compensatory outlet ports (2)
91 compensatory outlet clearances (1 of 2 is shown)
92 control ports (2)
93 sharp-edged orifices (2)
94 external conduits (2)
95 external torque motor
96 external shaft
97 hookup wires
98 thin clearances (1 of 2 is shown)
99 thin clearances (1 of 2 is shown)
102 compressive springs (4 are shown)

Additional Configurations

5 balanced, pressure-flow-compensated, single-stage valve
6 control assembly in constant hydrostatic compression
7 balanced, pressure-flow-compensated, single-stage valve
8 control assembly in potential hydrostatic compression
101 compressive springs (2)
102 compressive springs (2 are shown)
103 narrow sill
104 semicircular fluid-flow passage
105 spool
106 flange projecting shoulder
107 control assembly shaft
108 spacing ring
109 singular
111 inlet passages (1 pair is shown)
112 compensatory flange radial ducts (4 are shown)
113 primary flange radial ducts (4 are shown)
114 spacer counterbores (2)
115 resilient link
116 link retainers (interference fit with link 115, 2 are used)
117 slidable spacers (2)
118 outlet passages (2 pairs are shown)
119 capillaries (2)
121 compressive bellows (2)
122 magnetic armatures (2)
123 permanent magnet
124 motor magnetic flanges (2)
125 motor magnetic core cover
126 motor magnetic core member
127 singular inlet port
128 outlet ports (2)
129 drain ducts (2)
131 rigid weighted link (nonmagnetic)
132 armature pivots (2)
133 external soleniodal coils (4)
134 nonmagnetic spacers (2)
135 optional compressive springs (2)
136 relief ducts (2)

DESCRIPTION OF THE INVENTION

Description of the Preferred Embodiment: Translational Configuration

Figure 2:
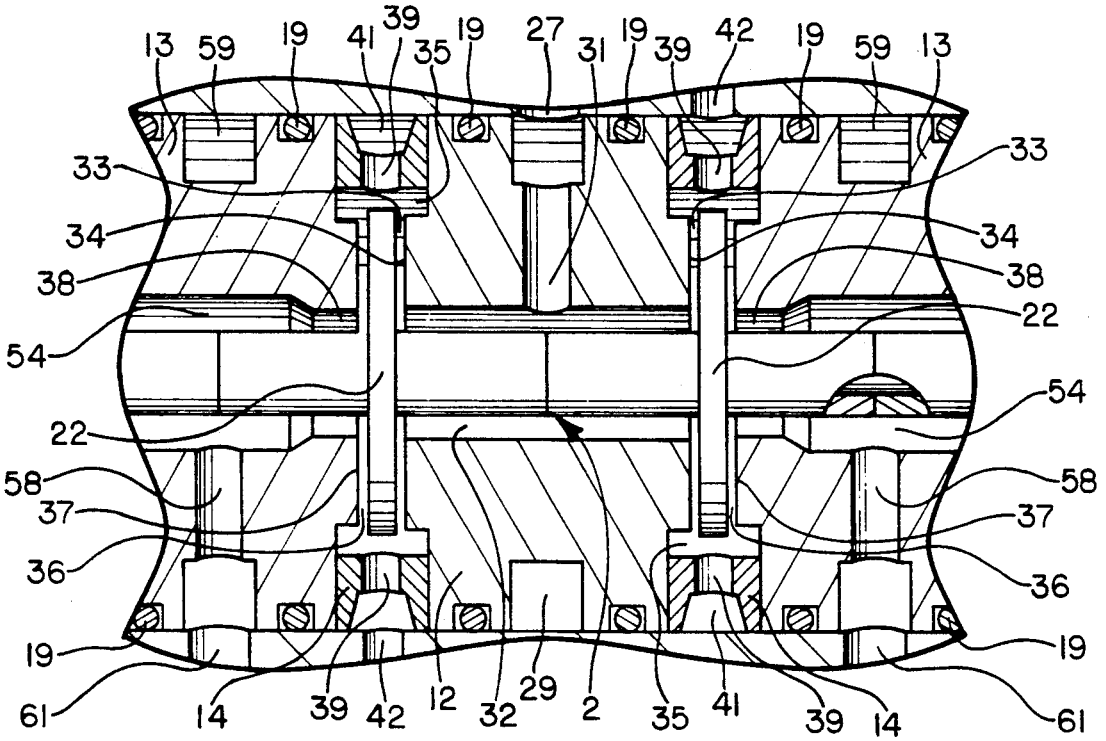
FIG. 2 shows an expanded view of the central portion of the valve of FIG. 1, further detailing the interior valve components. Except for the moveable assembly, all the components illustrated are shown in full section.
Figure 3:
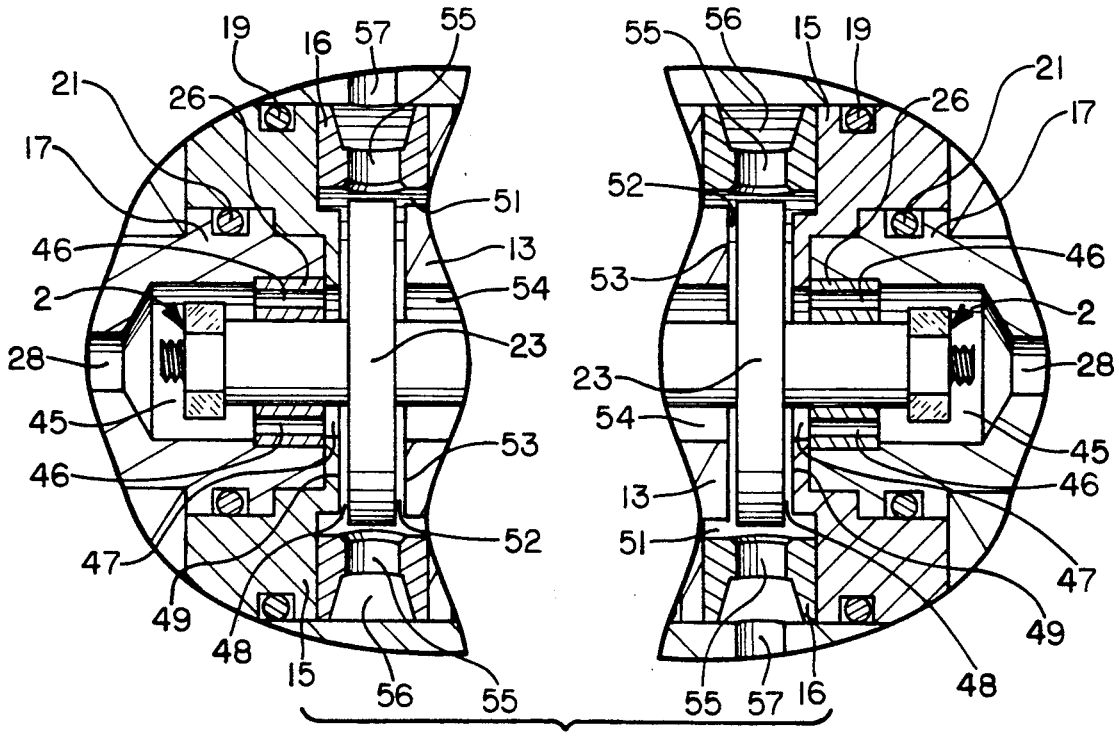
FIG. 3 shows expanded views of the ends of the valve of FIG. 1, further detailing the interior valve components. Except for the moveable assembly, all the valve components illustrated are shown in full section.

Referring now to the drawings and particularly to FIG. 1, the reference character 1 represents a balanced, pressure-flow-compensated, single-stage servovalve having a single moving control assembly, 2, mounted for axially reciprocable displacement within an annular housing 11. Inner spool 12 is positioned directly between outer spools 13, spaced apart from them by compensatory rings 14. End spools 15 are spaced apart from outer spools 13 by primary rings 16. End caps 17, which are secured to housing 11 by cap screws 18, are seated against end spools 15. O-ring seals 19 (numbered in FIG. 2 and FIG. 3), fitted around spools 12, 13, and 15, and O-ring seals 21 (numbered in FIG. 3) fitted around end caps 17, retard internal leakage of fluid. Control assembly 2 is comprised of compensatory flanges 22 and primary flanges 23, mounted together on a shaft, 24. Each of the flanges 22 and 23 is shaped like a disk, but having a sleeve projecting perpendicularly from the center of each of its two faces. A bore passes coaxially through the sleeves and thus through the center of each flange. The flanges 22 and 23 are secured together along shaft 24, which passes through their bores, using lock nuts 25. The flanges 22 and 23 are spaced apart at regular intervals by their projecting sleeves, so that they each interpose adjacent faces of spools 12 and 13, and 13 and 15, respectively. Control assembly 2 moves freely in the axial direction between spools 12, 13 and 15, sliding in guides 26.

Hydraulic fluid is supplied at a common pressure to valve 1, though central inlet port 27 of housing 11, and through end-cap inlet ports 28. The fluid which enters central inlet port 27 must then pass into inlet chamber 29, through inlet passage 31, and on into inner spool bore 32, where it divides into efferent flows that are directed toward either end of valve 1. As evident from FIG. 2, the efferent flows each exit inner spool bore 32, pass through a compensatory inlet clearance 33—the gap between the inner face of the adjacent compensatory flange 22 and a compensatory inlet sill 34 (the raised shoulder, on either face of inner spool 12, which surrounds the opening to the inner spool bore 32)—and into a compensatory chamber 35. From the compensatory chambers 35, the efferent flows each divide and pass either through a compensatory outlet clearance 36—the gap between the outer face of a compensatory flange 22 and a compensatory outlet sill 37 (the raised shoulder, on the innermost face of an outer spool 13, which surrounds the opening to an outer spool bore 38)—and into an outer spool bore 38; or through a compensatory ring hole 39, into a compensatory ring cavity 41, and (referring to FIG. 1) thence through compensatory control passage 42, sharp-edged orifice 43, and out of valve 1 through a control port 44. Referring again to FIG. 1, the fluid entering end-cap inlet ports 28 forms afferent flows, each directed toward the center of valve 1. As evident from FIG. 3, these afferent flows each pass from end-cap inlet ports 28, into an end-cap counterbore 45, through a guide bypass hole 46, and into an end-spool bore 47. From within each end-spool bore 47, the afferent flow passes through a primary inlet clearance 48—the gap between the outer face of the adjacent primary flange 23 and a primary inlet sill 49 (the raised shoulder, on the innermost face of an end spool 15, which surrounds the opening to an end-spool bore 47)—and thence into a primary chamber 51. From primary chambers 51, the afferent flows each divide and pass either through a primary outlet clearance 52—the gap between the inner face of a primary flange 23 and a primary outlet sill 53 (the raised shoulder, on the outermost face of an outer spool 13, which surrounds the opening to an outer spool counterbore 54)—and into an outer spool counterbore 54; or through a primary ring hole 55, into a primary ring cavity 56, and (referring to FIG. 1) thence through a primary control passage 57 and out of valve 1 through a control port 44. Referring again to FIG. 1, the efferent flows—after having entered outer spool bores 38 from compensatory chambers 35—then pass into outer spool counterbores 54, where they each join with the afferent flow (entering from primary chambers 51) therein. These combined flows, within each outer spool 13, then pass through an outlet passage 58, into an outlet chamber 59, through an outlet port 61, and out of valve 1—at a common return pressure.

Thus, fluid is supplied to valve 1 through inlet ports 27 and 28 and is returned from valve 1 through outlet ports 61. However, fluid may also enter or exit valve 1 through control ports 44. As described above, flow exiting a control port 44 consists of a divided efferent flow, passing from a compensatory ring cavity 41 through an orifice 43 (via a compensatory control passage 42), combined with a divided afferent flow, passing from a primary ring cavity 56 through a primary control passage 57. Flow which enters a control port 44 then divides so that one separated flow continues through a primary control passage 57 and the other through an orifice 43. The separated flow which passes through a primary control passage 57 continues through a primary ring cavity 56, through primary ring holes 55, and into a primary chamber 51, where it joins with the afferent flow therein. These conjoined flows then exit chamber 51, through a primary outlet clearance 52. The separated flow which passes through an orifice 43, continues through a compensatory control passage 42, and then through a compensatory ring cavity 41, through compensatory ring holes 39, and into a compensatory chamber 35, where it joins with the efferent flow therein. These conjoined flows then exit chamber 35, through a compensatory outlet clearance 36.

Substantial symmetry exists in valve 1. The spools are sized identically on either side of the middle of valve 1 (the center of inner spool 12). In particular, the sills on spools 12, 13 and 15 on one side of the middle of valve 1 are dimensioned identically to their counterparts on the other side of the valve. Thus, the inside diameters of the compensatory inlet sills 34 (FIG. 2)—which are the same as the diameter of the inner spool bore 32—are equal; the outside diameters of the compensatory inlet sills 34 are equal. Furthermore, the radial dimensions of the compensatory outlet sills 37 (FIG. 2) are identical: the inside diameters, which are the same as the diameters of the outer spool bores 38, are equal; the outside diameters are equal. Similarly, the inside diameters and the outside diameters, respectively, of the primary inlet sills 49 (FIG. 3) are equal. (It should be noted that the inside diameters of primary inlet sills 49 are the same as the diameters of end-spool bores 47.) Also, the inside diameters and the outside diameters of the primary outlet sills 53 (FIG. 2) are equal, respectively. (It should be noted that the inside diameters of primary outlet sills 53 are the same as the diameters of outer spool counterbores 54.) When control assembly 2 is centered between spools 12, 13 and 15, compensatory inlet clearances 33 (FIG. 2) are equal; compensatory outlet clearances 36 (FIG. 2) are equal; primary inlet clearances 48 (FIG. 3) are equal; and primary outlet clearances 52 (FIG. 3) are equal. Furthermore, orifices 43 (FIG. 1) are identical.

Figure 4:
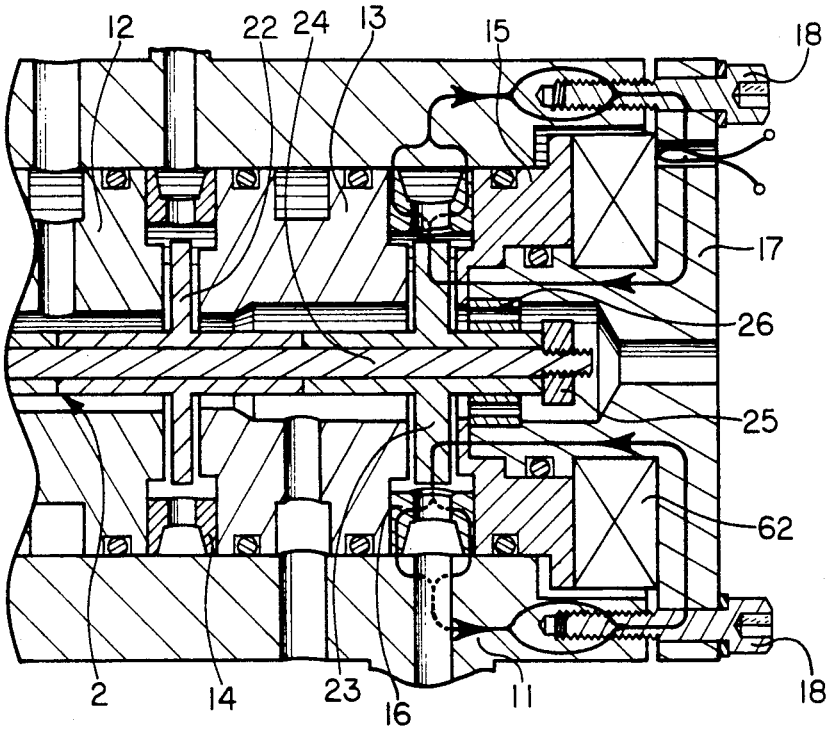
FIG. 4 shows an interior view of one side of the valve of FIG. 1, illustrating the magnetic circuit of the force motor therein. (The magnetic circuit for the second force motor—located symmetrically on the opposite side of the valve—is not shown, but is a mirror-image of that illustrated.) All valve components illustrated are shown in full section.

Internal electromagnetic force motors are located on either end of valve 1. Referring to FIG. 1, solenoidal coils 62 are wound around end caps 17. Access holes 63 allow hookup wires 64 from solenoidal coils 62 to be connected to a source of electrical current. End caps 17, cap screws 18, housing 11, primary rings 16, and primary flanges 23 are made of a highly permeable, magnetically soft material, such as low-carbon steel. Spools 12, 13 and 15, guides 26, and—optionally—compensatory flanges 22 and compensatory rings 14, are made of a nonmagnetic material, such as stainless steel. The typical magnetic circuit for a motor on one end of valve 1 is shown in FIG. 4.

Figure 5:
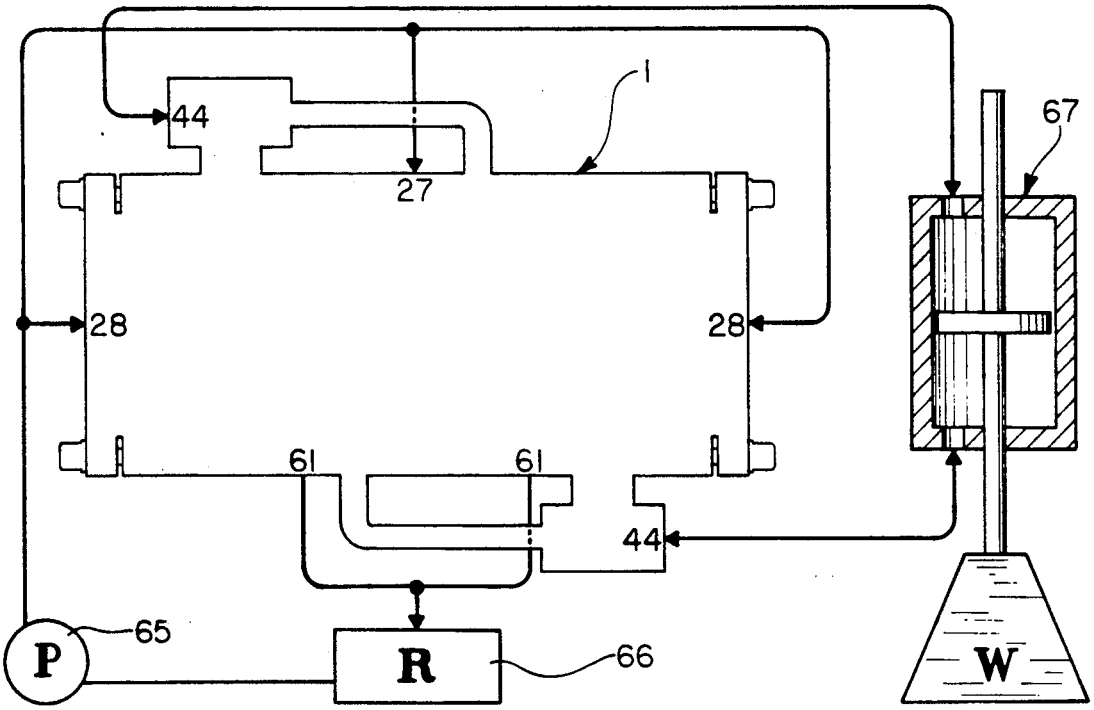
FIG. 5 illustrates how the valve of FIG. 1 is typically connected in a hydraulic system. The hydraulic actuator is shown in full section. However, all other system components are more simply depicted, and are labeled explicitly.

In FIG. 5, valve 1 is represented as it is typically connected in a hydraulic system. Inlet ports 27 and 28 are interconnected, and are all connected to the same source of fluid pressure, pump 65. Outlet ports 61 are interconnected and are connected to the same low-pressure fluid reservoir 66. Control ports 44 are connected to opposite sides of a double-acting, double-end rod cylinder 67. Since, for a given displacement of the piston in cylinder 67, the volume of control fluid displaced from one end of cylinder 67 is equal in magnitude to that entering the other end, the control flows through control ports 44 are equal in magnitude, but opposite in direction.

Operation of the Preferred Embodiment: Translational Configuration

Overview

The fluid power delivered to hydraulic cylinder 67 is determined by the position of control assembly 2 within valve 1. Axial movement of the control assembly 2 alters the individual clearances 33, 36, 48 and 52, thereby changing the flow through each clearance, and thus, ultimately, through control ports 44. Electromagnetic force, applied axially, controls the position of assembly 2 between spools 12, 13 and 15. The applied force counteracts the axial resultant of the combined hydrostatic and hydrodynamic forces. However, due to symmetry, the principal internal forces on either side of the middle of the valve are approximately equal in magnitude and are balanced upon control assembly 2. These mutually corresponding axial hydrostatic forces and mutually corresponding axial hydrodynamic forces are counterposed upon control assembly 2. The resultants of these corresponding forces are generally small; their magnitudes depend on the relative dimensions of the valve components. Whenever fluid flows between control ports 44, however, other axial hydrodynamic forces act in unison upon control assembly 2. These unidirectional hydrodynamic forces are unbalanced and therefore, destabilizing; they attempt to move the control assembly 2 away from a balanced position. However, these destabilizing hydrodynamic forces are compensated in the invention by axial hydrostatic forces which vary in proportion to the flow between control ports 44. In this way, all internal axial forces are substantially balanced upon control assembly 2. For this reason, the applied force needed to position control assembly 2 within valve 1 is generally small.

Detailed Explanation

The principal balance of forces is achieved through valve symmetry: the major axial hydrostatic and hydrodynamic forces on one side of valve 1 are oriented in opposition to mutually corresponding forces on the other side, all acting upon the control assembly 2. Of these major axial forces, the hydrostatic forces, developed by the considerable internal fluid pressures acting upon surfaces of the control assembly 2, predominate The axial hydrodynamic forces—which are proportional the square of axial flow—are comparatively small, owing to the relatively slow axial flows which are present in this type of valve. (Generally, the comparatively unrestricted axial flows are much slower than the restricted radial flows which pass through the thin-passage fluid-metering clearances.) Indeed, the velocities of axial flows are limited through proper valve design: in order to obtain optimum valve performance, laminar flow conditions must be maintained within the radial fluid-metering clearances. Thus, the axial fluid velocities within the unrestricted axial passages are also well within the laminar range, thereby minimizing the axial hydrodynamic forces. Furthermore, any net non-axial hydrostatic or hydrodynamic forces are also relatively small, and, therefore, have little influence upon the control assembly 2, which is constrained for axial movement.

The symmetrical arrangement of the internal valve passages causes equal axial counterpressures to be directed in mutual opposition upon the control assembly 2. Outlet ports 61 and inlet ports 28 are each located symmetrically with respect to the middle of valve 1; inlet port 27 is located in the middle of valve 1. Since the inlet ports 27 and 28 are interconnected externally, as shown in FIG. 5, equal pressures are delivered to both inner spool bore 32 and end-spool bores 47. Since the outlet ports 61 are also interconnected, equal pressures exist at the outer spool bores 38 and outer spool counterbores 54. Because the internal valve components are dimensioned identically on either side of the middle of the valve 1, the axial hydrostatic forces developed on either side of the middle of the valve 1 from within each symmetrical end of inner spool bore 32, or from within symmetrically positioned end-spool bores 47, or from within corresponding outer spool bores 38, or from within corresponding outer spool counterbores 54, respectively, are precisely counterpoised upon the control assembly 2. Furthermore, when the pressures in corresponding compensatory chambers 35 on either side of the middle of the valve 1 are equal, the axial hydrostatic forces developed within the corresponding compensatory clearances 33 and 36, respectively, on either side of the middle of the valve 1, are precisely counterpoised upon the control assembly 2: the equal pressures produce identical radial pressure distributions through like clearances 33 and 36, respectively, on either side of the middle of the valve 1. And again, when the pressures in corresponding primary chambers 51 on either side of the middle of the valve 1 are equal, the axial hydrostatic forces developed within the corresponding primary clearances 48 and 52, respectively, on either side of the middle of the valve 1, are precisely counterpoised upon the control assembly 2: the equal pressures produce identical radial pressure distributions through like clearances 48 and 52, respectively, on either side of the middle of the valve 1. Thus, the aforementioned hydrostatic forces, each offset by an opposing counterpart, have no combined effect on the control assembly 2 when equal pressures exist within corresponding chambers.

The symmetrical arrangement of the valve passages within valve 11 also causes corresponding axial counterflows to be directed in mutual opposition upon the control assembly 2. When the control assembly 2 is centered within its range of displacement, each clearance 33, 36, 48 or 52 on one side of the valve 1 is equal to its counterpart on the other side. For a given condition of chamber pressure and fluid viscosity, the inlet flow, outlet flow, and net flow (i.e., chamber control flow, that is, flow passing to or from a chamber 35 or 51, via a control port 44) through any single chamber 35 or 51 are determined solely by the relative distances between the chamber's two clearances 33 and 36, or 48 and 52, respectively. Furthermore, the chamber pressures are free to vary (only the difference in pressure between the control ports 44 and, therefore, between corresponding compensatory chambers 35 and between corresponding primary chambers 51, is determined by the external load on the cylinder 67) and, therefore, to stabilize at values for which the total fluid impedances (inlet to outlet) through corresponding chambers 35 or 51, respectively, are equal. Given these conditions, valve symmetry then ensures that when no fluid flows between control ports 44, the bypass flows (flows passing from the inlet ports 27 or 28 to the outlet ports 61) through corresponding chambers 35 or corresponding chambers 51 are symmetrical: equal in each compensatory chamber 35, and equal in each primary chamber 51. Moreover, symmetry ensures that the hydrodynamic forces developed from mutually corresponding bypass flows on either side of the valve 1 are counterposed. Therefore, under null and other operating conditions of no control flow, each axial hydrodynamic force created by bypass flow on one side of valve 1 is counterpoised by a corresponding force developed on the other side. However, other nonsymmetrical net flows (either non-bypass net primary chamber control flows, each passing simply through a control port 44; or non-bypass net compensatory chamber control flows, each passing through an orifice 43 and thence through a control port 44) develop unbalanced axial hydrodynamic forces, which bear unidirectionally upon the control assembly 2.

The unbalanced hydrodynamic forces are destabilizing forces, and if left unchecked, would push the control assembly 2 from a balanced position between spools 12, 13 and 15. These unbalanced axial forces are oriented upon the control assembly 2 in the direction in which its further displacement would increase the nonsymmetrical control flows. Increasing the control flows would, in turn, further increase the unbalanced hydrodynamic forces, which are proportional to nonsymmetrical flow. In this way, the control assembly 2 would be pushed from a central position between the spools 12, 13 and 15, by increasing unbalanced forces, toward one side of the valve 1 or the other, until checked by the contact of flange 22 or 23 with any sill 34, 37, 49 or 53. If not otherwise offset, the unbalanced forces could then hold the control assembly 2 fixed against a sill 34, 37, 49 or 53—inhibiting normal valve operation.

In the invention, proportional hydrostatic forces counteract the unbalanced hydrodynamic forces, thereby stabilizing the control assembly 2. However, in order to stabilize the valve in this way, these compensative hydrostatic forces must: (1) vary in proportion to the unbalanced hydrodynamic forces, (2) counteract the unbalanced hydrodynamic forces, (3) be greater in magnitude than the unbalanced hydrodynamic forces over the range of displacement of control assembly 2, and (4) be small enough in magnitude to prevent oscillation of control assembly 2. Although the first three of these conditions taken together is sufficient to maintain static equilibrium, for some configurations of valve 1 the final condition may be needed to avoid excessive compensation, and thus prevent dynamic instability. These conditions are satisfied by means of several design constraints: first, those primary chambers 51 and compensatory chambers 35 having net flows (non-bypass, chamber control flows) which vary, with respect to displacement of control assembly 2, in proportion to each other, are interconnected; second, the fluid elements used to connect these primary and compensatory chambers 51 and 35 impede flow; and third, the spools 12, 13 and 15 are scaled so that in response to control flow, over the entire range of valve operating conditions, proportional hydrostatic forces counteract the unbalanced axial hydrodynamic forces, which bear axially upon the control assembly 2.

These design constraints are achieved in the invention by designing the valve in accordance with several guidelines. For the first constraint, each primary chamber 51 is connected to the compensatory chamber 35 located on the opposite side of valve 1. In isolating each primary chamber 51 from each compensatory chamber 35 having net flows that vary in inverse proportion, with respect to displacement of control assembly 2 (that is, adjacent chambers on the same side of the valve as each other), this constraint ensures greater flow efficiency: for a given flow supplied to the valve, control flow comprised of net flows from interconnected chambers 51 and 35, which are cumulative (since they vary in proportion to each other), is greater than that which would be comprised of net flows from unconnected chambers 51 and 35, which are subtractive (since they vary in inverse proportion to each other). For the second constraint, sharp-edged orifices 43, which develop differential pressures in proportion to the square of conducted flow, connect primary chambers 51 to compensatory chambers 35. For the third constraint, the sill radii are selected so that: (1) the net axial hydrostatic forces developed in interconnected primary and compensatory chambers, 51 and 35, act in unison upon the control assembly 2, (2) the net axial hydrostatic forces developed in unconnected primary chambers 51, and in unconnected compensatory chambers 35, are counterposed, (3) the net axial hydrostatic force in each chamber 35 or 51 is oriented toward that chamber's outlet port 61 and away from that chamber's inlet port 27 or 28, (4) the net axial hydrostatic force developed in each primary chamber 51 varies in proportion to chamber pressure (equal to the pressure in that chamber's primary control passage 57 and, therefore, in that chamber's control port 44), (5) the net axial hydrostatic force developed in each compensatory chamber 35 varies in inverse proportion to chamber pressure (equal to the pressure in that chamber's compensatory control passage 42), and (6) the magnitude of the net axial hydrostatic force developed in each compensatory chamber 35 is at least as sensitive to changes in pressure therein as is that developed in the primary chamber 51 connected thereto by an orifice 43.

With the use of these guidelines to satisfy the design constraints, valve symmetry then ensures that the net axial hydrostatic force developed in the invention offsets the sum of the unbalanced hydrodynamic forces developed within all chambers 35 and 51. In order to achieve this condition, the unbalanced hydrodynamic force which arises in any chamber 35 or 51—in direct proportion to the net flow conducted therein—must be counteracted by an opposing hydrostatic force. The unbalanced hydrodynamic force occurring within any chamber 35 or 51 is directed axially upon control assembly 2, its orientation depending upon whether net flow enters or exits the chamber. When net flow exits the chamber (exiting the valve 1 via the control port 44 connected thereto), the unbalanced hydrodynamic force is oriented toward that chamber's outlet port 61. Conversely, when net flow enters the chamber (entering the valve 1 via the control port 44 connected thereto), the unbalanced hydrodynamic force is oriented toward that chamber's inlet port 27 or 28. Since most applications utilize a double-sided actuator, of which each side is connected to a separate control port 44, control flow enters one control port while exiting the other. Then, due to valve symmetry, the unbalanced hydrodynamic forces in all chambers 35 and 51 are oriented similarly, each directed axially against control assembly 2 and, therefore, contributing to the total unbalanced force.

Hydrostatic forces must be developed to offset each of these unbalanced hydrodynamic forces. However, valve symmetry ensures that under conditions of equal pressures in all chambers 35 and 51, no net axial hydrostatic force exists between the chambers: the hydrostatic forces are precisely counterpoised upon the control assembly 2. Thus, in order to create the hydrostatic forces needed to counteract unbalanced hydrodynamic forces, a difference in pressure must be developed between some of the chambers 35 or 51. Furthermore, since control flow may be present even with pressures equal between the control ports 44, the accompanying unbalanced hydrodynamic forces must be counteracted using differences in pressure developed solely between those chambers 35 and 51 which are interconnected. The required differences in pressure are developed using flow-impeding orifices 43 to connect these chambers 35 and 51—each difference in pressure being proportional to the square of the net flow conducted through an orifice 43 and, hence, through a compensatory chamber 35. Moreover, since the net flows from connected chambers 35 and 51 are similarly directed—either both entering or both exiting their common control port—and vary in proportion to each other, the differences in pressure developed between these connected chambers 35 and 51 (and across orifices 43) are also proportional to the square of the net flows through the primary chambers 51. Thus, the differences in pressure developed between these connected chambers, 35 and 51, are proportional to the square of the total control flows through the control ports 44 and, therefore, to the cumulative unbalanced hydrodynamic forces (which are, in turn, proportional to the square of the non-symmetric axial flows) developed within these chambers. Between connected chambers 35 and 51, pressure is greater in the primary chamber 51 when control flow is entering their common control port 44, and greater in the compensatory chamber 35 when control flow is exiting their while remaining compatible with these valve characteristics, then, the net hydrostatic forces must be properly apportioned between the chambers 35 and 51. Thus, the six-part guideline meeting the third constraint, above, specifies the relative magnitude and orientation of these compensative hydrostatic forces, ensuring that the net axial hydrostatic force developed between all chambers 35 and 51 counteracts the net unbalanced hydrodynamic force. Selection of the sill dimensions according to this same guideline may be facilitated by utilizing the analytical methods commonly used to model hydrostatic bearings.

To obtain optimum valve performance, the flow impedances of the orifices 43 are selected to maintain stability of the control assembly 2 over the expected range of operating conditions. The orifices 43 must be designed with sufficient flow impedance to develop enough differential pressure between connected chambers 35 and 51, over the entire range of operating conditions, to offset any unbalanced hydrodynamic forces with hydrostatic forces. However, the use of too much flow impedance to connect chambers 35 and 51 should be avoided in order to prevent the occurence—under certain operating conditions— of dynamic instability in the valve. In particular, the use, in place of orifices 43, of flow-impeding elements in which the differential pressure varies in direct proportion to the conducted flow, such as capillary tubes, is more likely to produce instability; such a valve's stable operating range is more limited than that of a valve utilizing elements in which the differential pressure varies in proportion to the square of the conducted flow, such as sharp-edged orifices 43. Orifices 43 are designed with sufficient flow impedance to counter the unbalanced hydrodynamic forces for a static control assembly 2, but with insufficient flow impedance to cause the onset of dynamic instability in the operating valve 1.

While satisfying the four conditions required to maintain stability of the control assembly 2, the valve's load-flow characteristics can be substantially altered through minor adjustments to the component dimensions. For example, the sill radii can be selected for increased sensitivity of the net hydrostatic force developed within a chamber 35 or 51 to changes in chamber pressure. Such an alteration would augment the compensatory hydrostatic forces, increasing the pressure control characteristic of the valve. Alternatively, the flow impedance of orifices 43 might be changed either to modify the flow gain of the valve, or to decrease the sensitivity of valve performance to changes in fluid viscosity; increasing the flow impedance may decrease the flow gain of the valve 1 with respect to input current, but increase its stability.

Force applied to control assembly 2 controls its position within valve 1, and thereby determines the control flow delivered through control ports 44. Electromagnetic force is applied axially by means of solenoidal coils 62. Passing an electrical current through the wire of a coil 62 generates magnetic flux which attracts the control assembly 2 toward that coil. The magnetic flux passes largely through the relatively permeable components located on the same end of valve 1. Thus, magnetic flux passes from the inside of coils 62, through the inner parts of end caps 17, through the thin sections of nonmagnetic end spools 15, across primary inlet clearances 48, through primary flanges 23, across the annular gaps between primary flanges 23 and primary rings 16, through primary rings 16, through housing 11, through cap screws 18, and through the outermost portions of end caps 17, where it returns through the inside of coils 62. Since the coils 62 are located symmetrically to one another on opposite ends of the valve, they create opposing forces. The apportionment of the currents applied between the two coils 62 determines the magnitude and direction of the net force applied to control assembly 2. Generally, the net force is toward the coil 62 conducting the greater current.

Description of the Alternative Embodiment Rotary Configuration

Figure 6:
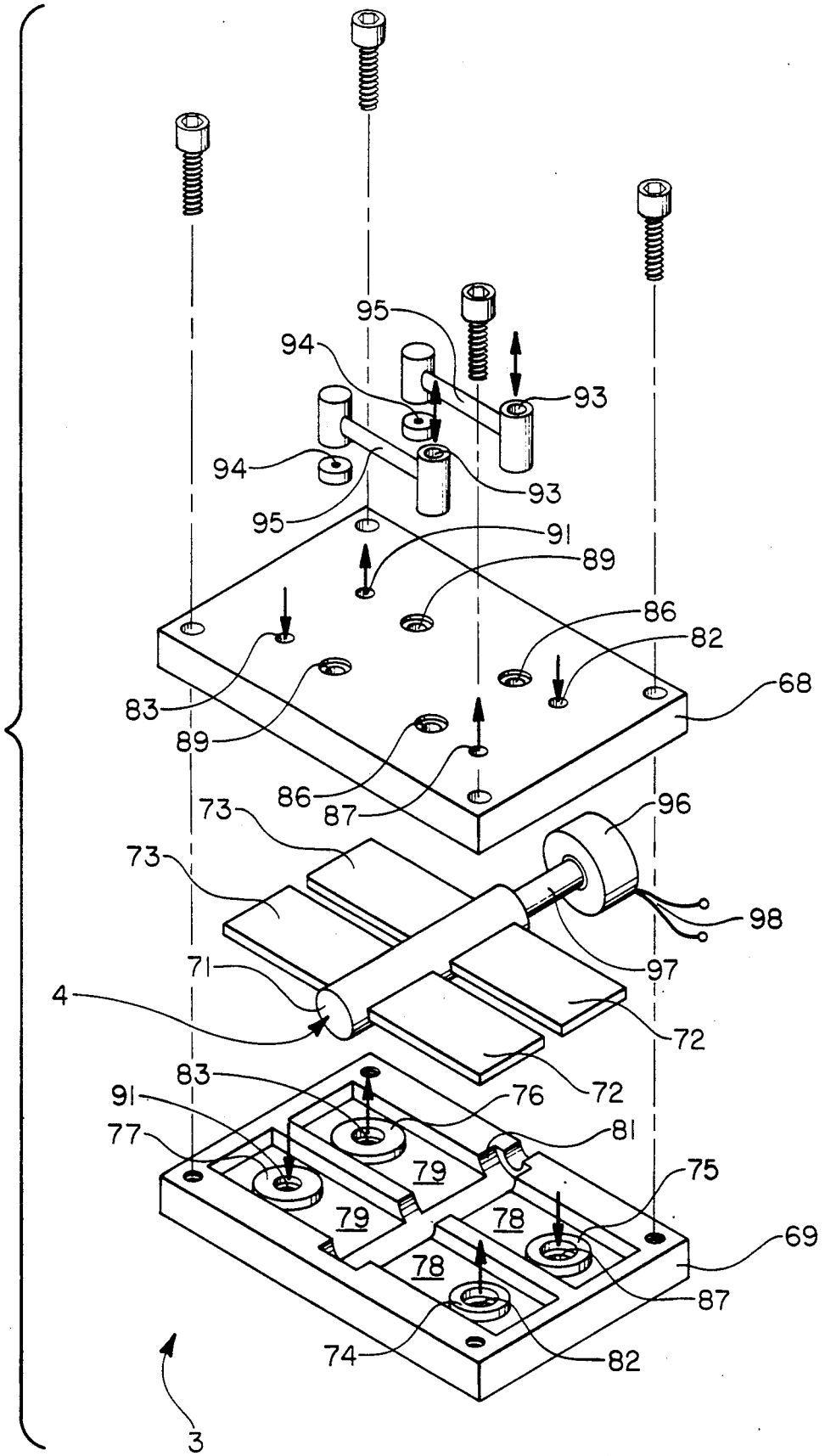
FIG. 6 shows an exploded assembly view of the alternative embodiment of the invention.
Figure 7:
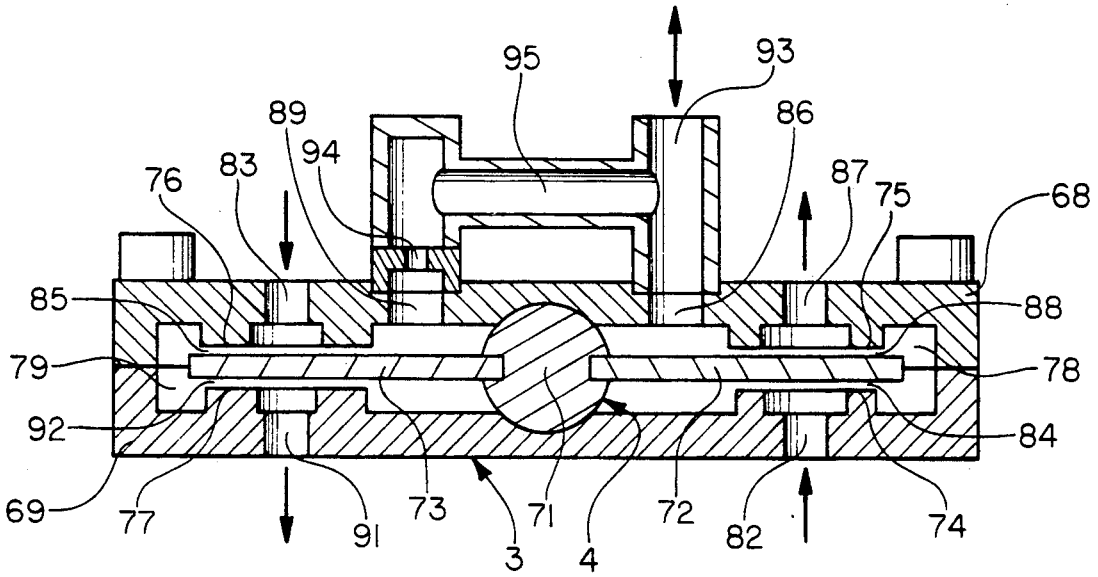
FIG. 7 shows an interior axial view of one of the two cavities of the valve of FIG. 6. All the valve components shown are in full section.

Referring now to FIG. 6 and FIG. 7, the reference character 3 represents a balanced, pressure-flow-compensated, single-stage servovalve having a single moving control assembly, 4, mounted for rotational reciprocable displacement within the two cavities formed between upper plate 68 and lower plate 69. Control assembly 4 consists of a central shaft 71 having radially projecting primary fins 72 and compensatory fins 73, each extending, in an axial plane, either fully between the faces of primary inlet sills 74 and primary outlet sills 75, or between the faces of compensatory inlet sills 76 and compensatory outlet sills 77, of housing plates 68 and 69. Thus mounted, the shaft 71 of the control assembly 4 divides each cavity between plates 68 and 69 into two chambers: a primary chamber, 78, and a compensatory chamber, 79. In this configuration, the primary chambers 78 are located adjacent to each other on the same side of the shaft 71 of control assembly 4. Also, the compensatory chambers 79 are located adjacent to each other, but on the opposite side of the shaft 71 of control assembly 4. The control assembly 4 rotates in the bearing surfaces 81 of plates 68 and 69, its projecting fins 72 and 73 limiting the range of its displacement between sills 74, 75, 76 and 77.

Hydraulic fluid is supplied at a common pressure to valve 3 through primary inlet ports 82 and compensatory inlet ports 83 of plates 68 and 69. The fluid passes from each primary inlet port 82 into a primary chamber 78 through the chamber's primary inlet clearance 84—the gap, shown in FIG. 7, between primary fin 72 and primary inlet sill 74 (the raised shoulder, in each cavity between plates 68 and 69, surrounding the interior bore of the primary inlet port 82). Likewise, the fluid passes from each compensatory inlet port 83 into a compensatory chamber 79 through the chamber's compensatory inlet clearance 85—the gap, shown in FIG. 7, between the compensatory fin 73 and compensatory inlet sill 76 (the raised shoulder, in each cavity between plates 68 and 69, surrounding the interior bore of the compensatory inlet port 83). From each primary chamber 78, fluid then passes either directly through a primary chamber port 86, or through a primary outlet port 87 via primary outlet clearance 88—the gap, shown in FIG. 7, between the primary fin 72 and the primary outlet sill 75 (the raised shoulder, in each cavity between plates 68 and 69, surrounding the interior bore of the primary outlet port 87). From each compensatory chamber 79, fluid then passes either directly through a compensatory chamber port 89, or through a compensatory outlet port 91 via compensatory outlet clearance 92—the gap, shown in FIG. 7, between the compensatory fin 73 and the compensatory outlet sill 77 (the raised shoulder, in each cavity between plates 68 and 69, surrounding the interior bore of the compensatory outlet port 91). Fluid may enter or exit primary chamber ports 86 and compensatory chamber ports 89. Each primary chamber port 86 is connected to a separate control port 93. Each compensatory chamber port 89 is connected to a separate primary chamber port 86 via a sharp-edged orifice 94 and an external conduit 95. Thus, fluid which passes through a compensatory chamber port 89 must also pass through an orifice 94. However, fluid entering or exiting a control port 93 may flow either through an orifice 94 (via an external conduit 95) or through a primary chamber port 86.

As in the preferred embodiment, substantial symmetry exists in valve 3. Each primary inlet port 82, primary outlet port 87, compensatory inlet port 83, and compensatory outlet port 91, in one cavity—between plates 68 and 69—is located the same distance from the axis of the control assembly 4 as its counterpart in the other cavity. In addition, plates 68 and 69 each contain one of all the four types of sills 74, 75, 76 and 77; for each sill on plate 68 an identical sill is located on plate 69, on the same side of shaft 71 but in the opposite cavity. Thus (referring mainly to FIG. 7), the inside diameters of the primary inlet sills 74 are equal; the outside diameters of the primary inlet sills 74 are equal; the inside diameters and the outside diameters, respectively, of the primary outlet sills 75 are equal; the inside diameters and the outside diameters, respectively, of the compensatory inlet sills 76 are equal; and the inside diameters and the outside diameters, respectively, of the compensatory outlet sills 77 are equal. Furthermore (referring still to FIG. 7), because of symmetry, when control assembly 4 is centered between plates 68 and 69, primary inlet clearances 84 are equal; primary outlet clearances 88 are equal; compensatory inlet clearances 85 are equal; and compensatory outlet clearances 92 are equal. Lastly, orifices 94 (FIG. 6) are identical.

External torque motor 96, shown in FIG. 6, moves control assembly 4. Connected to control assembly 4 via an external shaft 97, the motor rotates the assembly between primary sills 74 and 75, and between compensatory sills 76 and 77, in response to an electrical signal applied via hookup wires 98 attached thereto.

As with valve 1, shown in FIG. 5, valve 3 is connected in a hydraulic system, and as in the preferred embodiment, all inlet ports, 82 and 83, are interconnected and connected to the same source of fluid pressure. Likewise, all of the outlet ports, 87 and 91, are interconnected and connected to the same low-pressure fluid reservoir. Also, control ports 93 are typically connected to opposite sides of a double-acting, double-end rod cylinder. Again, as in the preferred embodiment, the control flows through control ports 93 are thus equal in magnitude, but opposite in direction.

Operation of the Alternative Embodiment: Rotary Configuration

Due to their analogous valve symmetries, operation of the rotary configuration is akin to that of the translational configuration. However, in the rotary configuration, hydrostatic and hydrodynamic forces bear—in each of the chambers 78 and 79—upon the control assembly 4, to produce counterposing torques between the two cavities of the valve 3. As in the preferred embodiment, the principal balance of forces is achieved through valve symmetry: the major hydrostatic and hydrodynamic torques produced in one cavity between plates 68 and 69 are oriented in opposition to mutually corresponding torques produced in the other cavity. Moreover, of these major forces, the hydrostatic forces again predominate.

The symmetrical arrangement of the internal valve passages in this embodiment again causes equal counterpressures to be directed, in mutual opposition, upon the control assembly 4. As in the preferred embodiment, the inlet ports 82 and 83 are interconnected externally; and the outlet ports 87 and 91 are interconnected externally. Therefore, equal pressures are delivered to the inlet ports 82 and 83; and equal pressures exist at the outlet ports 87 and 91. Furthermore, since corresponding internal valve components are dimensioned identically between the two cavities, the mutually corresponding hydrostatic forces developed within inlet ports 82 and 83, respectively, and within outlet ports 87 and 91, respectively, between the two cavities, produce mutually corresponding torques which are precisely couterpoised upon the control assembly 4. And since the corresponding sills 74, 75, 76 and 77 are dimensioned identically between the two cavities, the hydrostatic forces developed within the clearances of corresponding primary chambers 78, or severally, within the clearances of corresponding compensatory chambers 79, produce opposing torques which bear equally upon the control assembly 4, whenever equal chamber pressures are developed between corresponding chambers 78 or corresponding chambers 79, respectively. Thus, as in the preferred embodiment, the hydrostatic forces, each producing a torque in one cavity which is offset by an opposing torque developed by its counterpart in the other cavity, have no combined effect on the control assembly 4 when equal pressures exist within corresponding chambers.

The symmetrical arrangement of the internal valve passages within valve 3 also causes mutually corresponding counterflows—one in each separate cavity—to be directed against the faces of the fins 72 and 73 of control assembly 4. These counterflows, in turn, produce hydrodynamic forces which exert counterposing torques upon the control assembly 4. As in the preferred embodiment, when control assembly 4 is centered within its range of displacement, each clearance 84, 85, 88 and 92 in one cavity is equal to its counterpart in the other cavity. Also, for a given condition of chamber pressure and fluid viscosity, the inlet flow, outlet flow, and net flow through any single chamber 78 or 79 are again determined solely by the relative distances between the chamber's two clearances, 84 and 88 in primary chambers 78, or 85 and 92 in compensatory chambers 79. Furthermore, the chamber pressures are again free to vary and, therefore, to stabilize at values for which the total fluid impedances (inlet to outlet) through corresponding chambers 78 or through corresponding chambers 79, respectively, are equal. Given these conditions, valve symmetry again ensures that during conditions of no control flow, the bypass flows through corresponding chambers 78 or through corresponding chambers 79 are symmetrical: equal in each primary chamber 78, and equal in each compensatory chamber 79. Moreover, symmetry again ensures that the hydrodynamic forces developed by mutually corresponding bypass flows within the separate cavities of valve 3 are counterposed. Therefore, under null and other operating conditions of no control flow, each hydrodynamic torque created by bypass flow in one cavity of valve 3 is counterpoised by a corresponding hydrodynamic torque in the other cavity. However, as in the preferred embodiment, other nonsymmetrical net flows develop unbalanced hydrodynamic torques which bear unidirectionally upon the control assembly 4.

In the alternative embodiment, proportional hydrostatic forces develop torques which counteract the unbalanced hydrodynamic torques produced by the nonsymmetrical flows. Indeed, the same general conditions required to provide stability to the preferred embodiment also apply to the rotary configuration of the invention. Moreover, design constraints and guidelines which are directly analogous to those outlined for the preferred embodiment can be applied to this alternative embodiment.

Although the use of an internal motor is possible, for simplicity of illustration, an external torque motor 96 is used in this configuration. In response to an electrical signal, the motor rotates control assembly 4, controlling its position between the plates 68 and 69.

SCOPE OF THE INVENTION

The servovalve of the invention described herein may accurately control—in a single-stage—high-power hydraulic servomechanisms, using relatively low-power electrical signals. The invention may control hydraulic systems either directly, in a single stage; or, as mentioned, indirectly, when used to replace the primary stages in conventional sliding spool valves. In either case, the invention should provide an economical alternative to the use of multiple-stage electrohydraulic spool valves. The invention offers improved performance both near null and under loaded conditions; a wide range of available operating characteristics; expanded dynamic range; and greater operational reliability.

Figure 9:
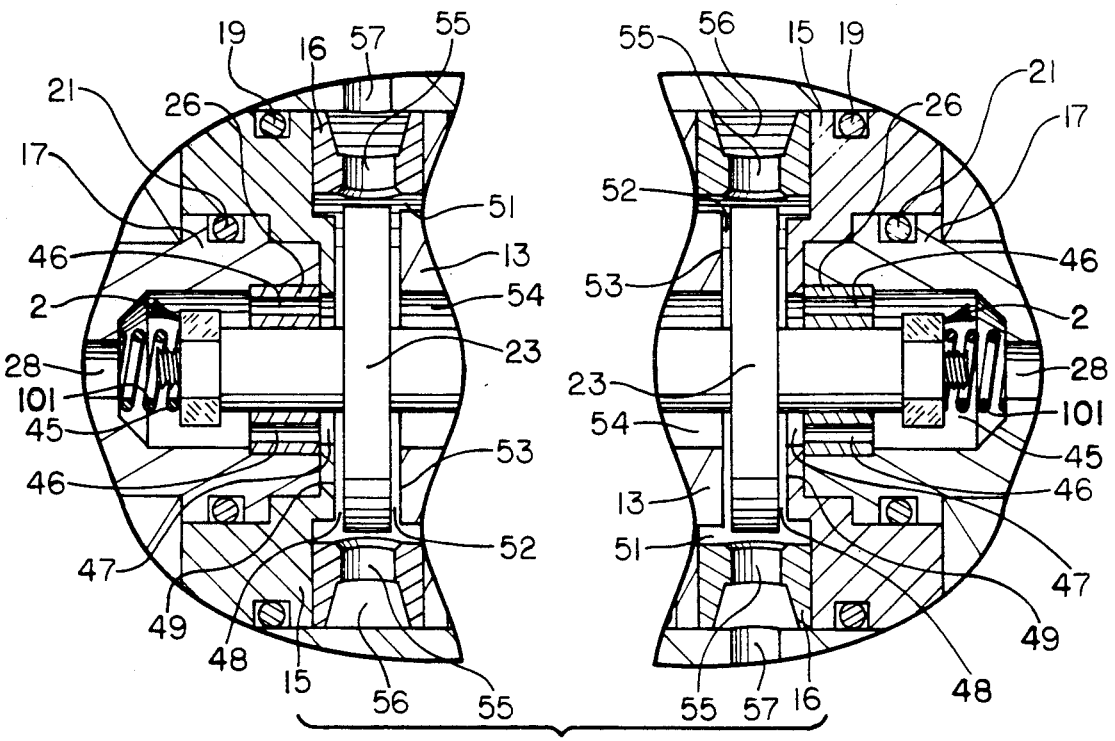
FIG. 9 shows views similar to FIG. 3, with the addition of restraining springs opposing translative displacement of the moveable assembly from a central position.
Figure 10:
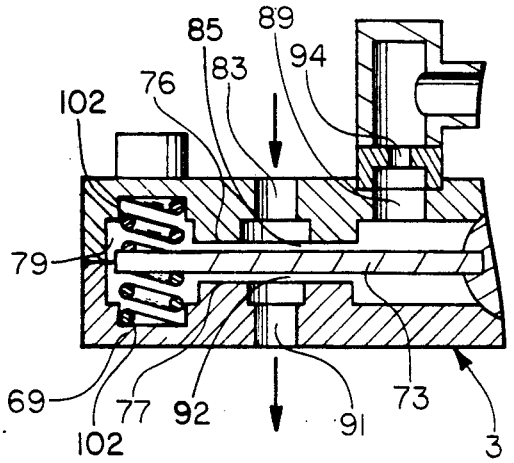
FIG. 10 shows a view similar to FIG. 7, with the addition of restraining springs opposing rotative displacement of the moveable assembly from a central position.

While the embodiments described above demonstrate specific aspects of the invention, these aspects should not be construed as limitations on the scope of the invention, since other embodiments are possible. For example, considering in particular the preferred embodiment, other flow-restricting means, such as capillary tubes, may either supplement or replace the orifices 43, in order to achieve different valve operating characteristics. Also, the relative locations of the various ports in the invention may be interchanged. Such changes would require simple alterations of the dimensions of the various internal components, in order to maintain the design guidelines and ensure proper operation of the valve. One such change would include interchanging the locations of the inlet ports 27 and 28 with the outlet ports 61, the inlet ports being then in the locations of 61, and the outlet ports being then in the locations 27 and 28. Another such change would include interchanging the locations of primary chambers 51 with compensatory chambers 35, also affecting the locations of the control ports 44 (which are always directly connected to primary chambers 51). Additionally, in order to achieve a range of other valve operating characteristics, the various clearances 33, 36, 48 and 52 may have differing gaps when the control assembly is centered within the valve. Moreover, as shown in FIG. 9, springs 101 could be used to augment the compensative forces, restraining displacement of the control assembly from a centered position (springs 103 are shown in FIG. 10 for the rotary configuration of the invention). Indeed, such springs, when of sufficient stiffness, could even be used to fully compensate the unbalanced hydrodynamic forces, thereby obviating the need for the compensative hydrostatic forces and, therefore, for the orifices 43. Various combinations of these changes could be made, while still retaining essentially the same range of valve operating characteristics as can be achieved in the preferred embodiment.

Figure 11:
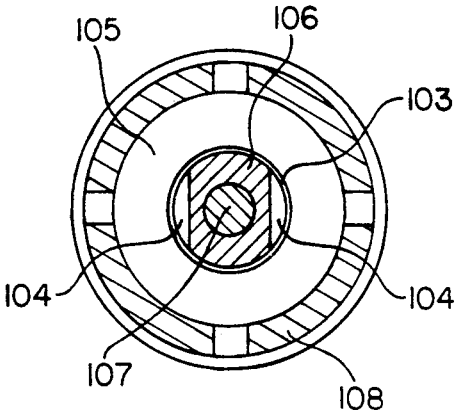
FIG. 11 shows an end view of a spool similar to those of the preferred embodiment, but modified with a relatively narrow fluid-flow sill. Also visible is the shoulder—shown in section—of the flange therein. Also seen in section is a spacing ring similar to those of the preferred embodiment.
Figure 12:
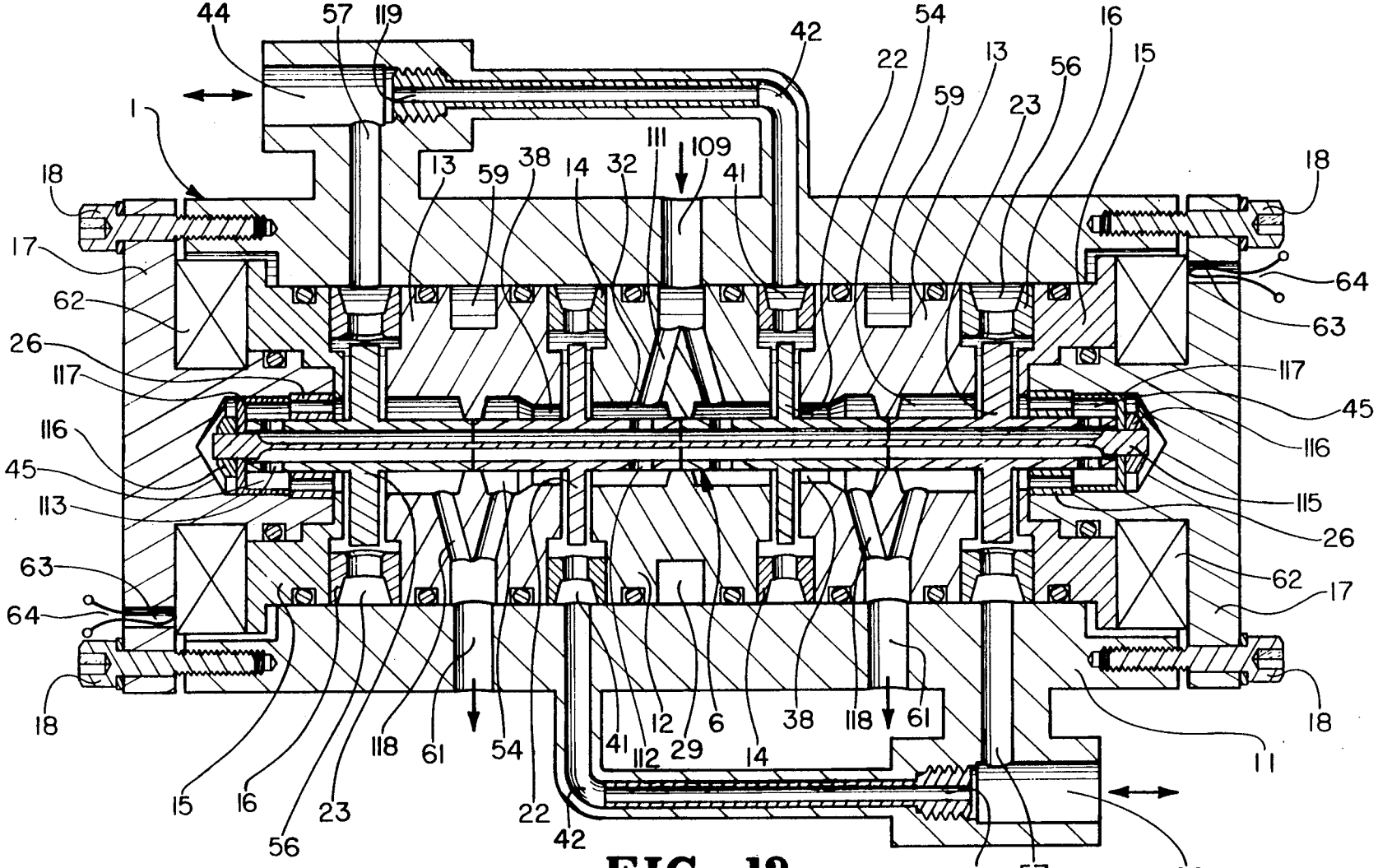
FIG. 12 shows a view similar to FIG. 1 of the preferred embodiment, but having only a single, centrally-located, fluid-supply port. Also shown, a thin, resilient link suspended axially through the bore of the moveable assembly restrains displacement of the moveable assembly from a central position. All valve components are shown in full section. In addition, capillaries are shown in place of the orifices of the preferred embodiment.

Other modifications to the preferred embodiment are also possible. For example, the projecting sills on the faces of spools 12, 13 and 15, could instead be incorporated into the faces of flanges 22 and 23, so that the spool faces remain flush. (The faces of each flange would have their outer diameters trimmed to the outer diameter of the corresponding sill.) In addition, the relatively wide sills 34, 37, 49 and 53 shown in the preferred embodiment could be made sufficiently narrow such that the flow regime through the clearances resembles more that through an orifice than that through a lengthy passage. Such a design might incorporate a narrow sill 103 in combination with a semicircular fluid-flow passage 104, as shown in FIG. 11. Moreover, in those configurations of valve 1 in which the balance of axial force between any two adjacent flanges 22, or 22 and 23, is maintained in compression, shaft 24, together with lock nuts 25, could be eliminated through the use of additional flange guides. Flange guides would be located within inner spool bore 32 and within outer spool counterbores 54, and would span the abutments between adjacent flanges 22, and 22 and 23. As shown in FIG. 12, fluid could then be supplied to end-cap counterbores 45 from singular inlet port 109 via the axial bore through control assembly 6, obviating the need for end-cap inlet ports 28: inlet fluid communication could be established via compensatory flange radial ducts 112 through the innermost sleeves of flanges 22, thereby connecting the inner spool bore 32, divided by the new central flange guide, with the axial bores through flanges 22 and 23; fluid within said axial bores exits through primary flange radial ducts 113 into spacer counterbores 114, and then passes through guides 26 as in the preferred embodiment. In addition, as shown in FIG. 12, a thin resilient link 115 could be so suspended within the bore through control assembly 6 that it would serve to restrain displacement of said control assembly from a central position. (Link retainers 116, press-fit into link 115, seat against slidable spacers 117.)

Figure 13:
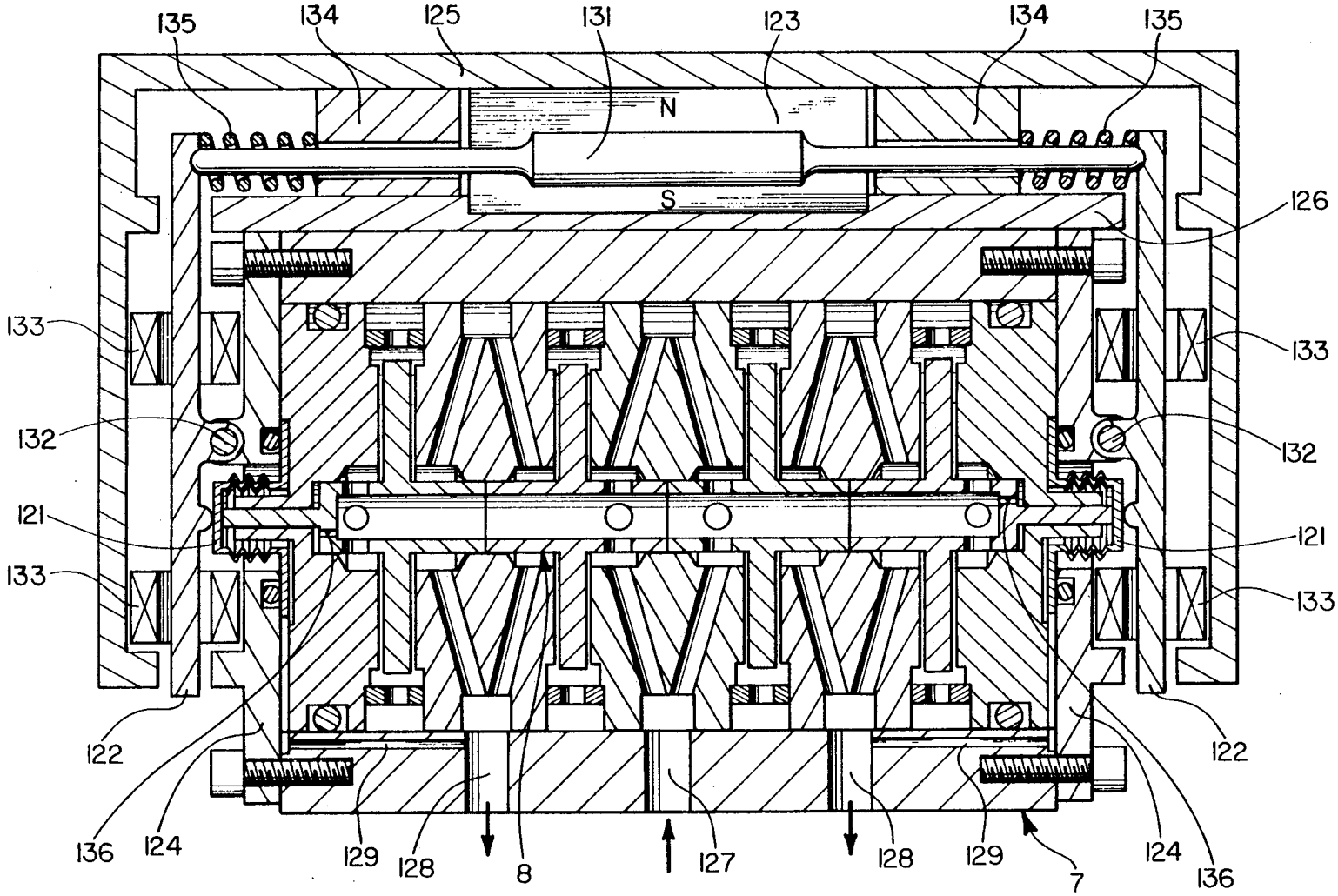
FIG. 13 shows a view similar to FIG. 12, generally in full section, relating to the preferred embodiment, but without the internal resilient link, and having an external force motor coupled to the moveable assembly through bellows located on either end of the valve. The twin armatures of the force motor are linked externally by a rigid weighted member, and are each mounted in a pivotal arrangement, whereby the sealing bellows and internal moveable assembly are all compressed together therebetween. Twin solenoidal coils encircle each armature. (Chamber ports, control ports and the fluid-passages therebetween, although present in this embodiment, are not shown in this view.)

Further potential modifications to the preferred embodiment include changes to the force motors which position the control assembly. For example, alternative electromagnetic motors could be substituted for the solenoidal coils 62. As shown in FIG. 13, the control assembly 8 could be linked to an external force motor using compressible bellows 121, thereby isolating all magnetic components 122, 123, 124, 125 and 126 from the fluid environment. In this design, the motor's twin armatures 122 are linked and pivoted externally, compressing said control assembly through the bellows. Thus held together externally, the outermost flanges of the control assembly could be in relative hydrostatic tension (as is generally the case when the fluid inlet and outlet ports, 127 and 128, respectively, are located in inverse relation to that shown in FIG. 13) without need for shaft 24 of the preferred embodiment. However, with the centrally located supply port shown in FIG. 13, the control assembly can be in hydrostatic compression, reducing the need for mechanical compression. Said pivoted armatures then serve to compress said bellows, whereupon nil hydrostatic force is exerted since drain ducts 129, connecting passages from the interior of the bellows to outlet ports 128, relieve any pressure developed therein. Furthermore, in this configuration of the invention, the influence of external forces upon the control assembly can be compensated through counterpoise of the pivoted armatures: through proper sizing of all moving compenents, 8, 121, 122 and 131, the net weight of the external compenents can counterbalance that of the control assembly, creating a single-stage valve insensitive to forces caused by valve motion or orientation. In addition, reducing the weight of the control assembly by attaching thereto floating elements located entirely within fluid chambers of the valve, could further reduce the valve's sensitivity to external forces.

In an alternative example, the force available from the internal electromagnetic motors of the preferred embodiment could be augmented through changes to the magnetic components. One such change, making compensatory flanges 22 and compensatory rings 14 of magnetic low-carbon steel (instead of nonmagnetic stainless steel), wuold extend the capacity of each magnetic circuit.

Still another possible modification to the preferred embodiment concerns fluid leakage within the valve: since minor fluid leakage between any of chambers 35 and 51 may have little effect on valve performance in the open-passage geometry of the invention, many of the internal seals are potentially unnecessary; instead, the internal components could be closely fitted, thereby allowing only a minimum of fluid leakage within the valve 1.

Figure 8:
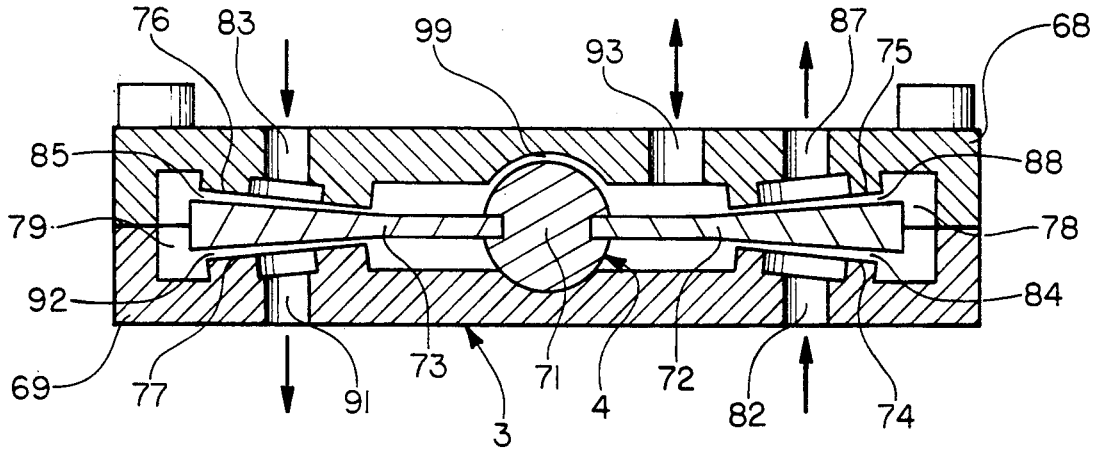
FIG. 8 shows an interior axial view of one of the two cavities of an alternative embodiment to the valve of FIG. 6. All the valve components shown are in full section.

Other embodiments are also possible in the rotary configuration of the invention. For example, the flow-impeding element used to connect each primary chamber 78 to a compensatory chamber 79 could be incorporated inside the body of the valve 3, perhaps, as shown in FIG. 8, as a thin clearance (99) between upper plate 68 and shaft 71. Fluid would then pass between the chambers 78 and 79—in each cavity formed between the plates 68 and 69—through the clearance around shaft 71. In addition, though not explicitly shown in the figures, seals may be used to retard fluid leakage both from the valve 3, and from between the two cavities between plates 68 and 69. Additional seals could also be used to further retard fluid leakage from between the two chambers 78 and 79 in each cavity between plates 68 and 69. Finally, changes analogous to many of those suggested above for the preferred embodiment can also be applied to the rotary configuration of the invention.

Thus, a variety of further embodiments may be obtained through changes to the embodiments of the invention described herein. Accordingly, the scope of the invention should not be determined by the embodiments illustrated, but by the appended claims and their legal equivalents.

I claim:

1. A balanced, pressure-compensated, single-stage hydraulic valve system with interconnected fluid-supply, interconnected fluid-return and distinct fluid-control ports, said hydraulic valve system being responsive to applied signals, and said system comprising:

(a) a plurality of chambers, with each said chamber having an inlet port, an outlet port, and a chamber port, each connected thereto;

(b) a displaceable control assembly, located largely within and extending between said chambers, and having substantially planar means, within each said chamber, with at least one said planar means intervening fully between said inlet port and said outlet port within each said chamber, so that simultaneously each said planar means is in the midrange between said inlet and said outlet ports therebeside when said assembly is positioned midway between displacive extremes;

(c) flow-impeding clearances, at least one being an inlet clearance between said planar means and the adjacent wall surrounding said inlet port of said chamber, and at least one being an outlet clearance between said planar means and the adjacent chamber wall surrounding said outlet port therebeside, each such said clearance forming within each said chamber when said control assembly is positioned intermediately between said displacive extremes;

(d) guiding means constraining displacive movement of said control assembly to be generally in the manner causing, within each said chamber, said inlet clearance to change in inverse proportion to said outlet clearance;

(e) means for displacing said control assembly, and thereby changing said clearances, in proportion to said signals;

(f) means to conduct fluid, substantially unimpeded, between each said inlet port and a said supply port, and between each said outlet port and a said return port; further, discrete means to conduct fluid, either relatively impeded or substantially unimpeded, between each said chamber port and a said control port, with each said control port being thus connected to sufficient distinct said chamber ports to thereby utilize at least one said discrete means impeding flow and one said discrete means not impeding flow, but connected only to said chamber ports of said chambers in which displacement of said control assembly changes said inlet clearances similarly therein, and, simultaneously, said outlet clearances similarly therein;

(g) means causing the net displacive hydrostatic force acting on said control assembly to counteract any net unbalanced displacive hydrodynamic force also acting thereupon, and, in the absence of unbalanced displacive hydrodynamic forces, to be generally small or nil, and to be negligible or nil when unbalanced displacive hydrodynamic forces are absent and equal pressures exist in all said chambers;

whereby, with equal fluid pressures delivered to said supply ports and with equal fluid pressures existing at said return ports, any unbalanced hydrodynamic forces acting to displace said control assembly are offset by proportional hydrostatic forces, thereby stabilizing said assembly between said inlet and said outlet ports, and enabling said system to control the flow delivered through said control ports, in response to said signals, through changes in the relative positions of said planar means within said chambers, by displacement of the thus stabilized said control assembly.

2. The system of claim 1 wherein means affecting the orientations and magnitudes of said hydrostatic forces acting on said control assembly in said chambers is proper sizing of the internal components, including said inlet and said outlet ports, said planar means, said inlet and said outlet clearances, and said fluid-conductive means impeding flow.

3. The system of claim 1 wherein each said fluid-conductive means impeding flow is an orifice.

4. The system of claim 1 wherein said control assembly is slidably mounted.

5. The system of claim 1 wherein said control assembly is mounted by resilient means which restrain said control assembly between said displacive extremes.

6. The system of claim 1 wherein said planar means are simultaneously each approximately halfway between said inlet and outlet ports therebeside when said assembly is positioned midway between said displacive extremes.

7. The system of claim 1 wherein said means for displacing said control assembly is a force motor.

8. The system of claim 1 wherein said signal is electrical.

9. The system of claim 1 having sealing means minimizing fluid leakage.

10. A balanced, pressure-compensated, single-stage hydraulic valve system with interconnected fluid-supply, interconnected fluid-return and distinct fluid-control ports, said hydraulic valve system being responsive to applied electrical signals, and said system comprising:

(a) a plurality of spools, juxtaposed coaxially in a cavity within a valve body and separated therein by spacing means therebetween, to form an even number of chambers, with said spacing means having means generally not impeding flow to conduct fluid radially therethrough, and with said chambers each interposed between the opening to an inlet bore, extending coaxially through one of the adjacent said spools therebeside, and the opening to an outlet bore, extending coaxially through the other adjacent said spool therebeside, and each having a chamber port, located between said adjacent spools in the wall of said cavity;

(b) a translatable control assembly extending between said chambers through said inlet bores and said outlet bores of said spools, said assembly comprising, firstly, a plurality of radially projecting flanges with at least one said flange intervening fully between said inlet bore and said outlet bore of each said chamber and, secondly, means to space apart said flanges so that, simultaneously, each is in the midrange between said adjacent spools therebeside when said assembly is positioned midway between translative extremes;

(c) flow-impeding clearances, at least one being an inlet clearance between said flange and the adjacent face surrounding said inlet bore of said adjacent spool, and at least one being an outlet clearance between said flange and the adjacent spool face surrounding said outlet bore therebeside, forming within each said chamber when said control assembly is positioned intermediately between said translative extremes;

(d) guiding means constraining translational movement of said control assembly to be generally codirectional with the axis of said spools, and thereby causing said translation to change, within each said chamber, said inlet clearance in reciprocal proportion to said outlet clearance;

(e) means for translating said control assembly, and thereby changing said clearances, in proportion to said electrical signals;

(f) means to conduct fluid, substantially unimpeded, between each said inlet bore and a said supply port, and between each said outlet bore and a said return port; further, discrete means to conduct fluid, either relatively impeded or substantially unimpeded, between each said chamber port and a said control port, with each said control port being thus connected to sufficient distinct said chamber ports to thereby utilize at least one said discrete means impeding flow and one said discrete means not impeding flow, but connected only to said chamber ports of said chambers in which translation of said control assembly changes said inlet clearances equally therein, and, simultaneously, said outlet clearances equally therein;

(g) means causing the net axial hydrostatic force acting on said control assembly, in the absence of any net unbalanced axial hydrodynamic forces acting on said assembly, to be generally small or nil;

(h) means causing the net axial hydrostatic forces acting on said control assembly, within said chambers having said chamber ports connected to the same said control port, to be similarly oriented; means causing the net axial hydrostatic forces acting on said control assembly in said chambers having said chamber ports connected to said control ports by said fluid-conductive means not impeding flow to be counterposed, and those in said chambers having said chamber ports connected to said control ports by said fluid-conductive means impeding flow to be counterposed; means causing the net axial hydrostatic force acting on said control assembly in each said chamber to be directed toward said outlet bore thereat, and away from said inlet bore thereat;

(j) means causing the net axial hydrostatic force acting on said control assembly in each said chamber having said chamber port connected to said control port by said fluid-conductive means not impeding flow, to vary in proportion to fluid pressure applied thereto via said chamber port thereat; means causing the net axial hydrostatic force acting on said control assembly, in each said chamber having said chamber port connected to said control port by said fluid-conductive means impeding flow, to vary in inverse proportion to fluid pressure applied thereto via said chamber port thereat; and means ensuring that the magnitudes of the net axial hydrostatic forces acting on said control assembly, in said chambers having said chamber ports connected to said control ports by said fluid-conductive means impeding flow, are at least as sensitive to changes in fluid pressure applied thereto via said chamber port thereat, as are those in said chambers having said chamber ports connected to said control ports by said fluid-conductive means not impeding flow;

whereby, with equal fluid pressures delivered to said supply ports and with equal fluid pressures existing at said return ports, any unbalanced axial hydrodynamic forces acting to translate said control assembly are offset by proportional axial hydrostatic forces, thereby stabilizing said assembly between said spools, and enabling said system to control the flow delivered through said control ports, in response to said electrical signals, through changes in the relative position of the thus stabilized said control assembly.

11. The system of claim 10 wherein said control assembly is mounted by resilient means which restrain said control assembly between said translative extremes.

12. A balanced, pressure-compensated, single-stage hydraulic valve system with interconnected fluid-supply, interconnected fluid-return and distinct fluid-control ports, said hydraulic valve system being responsive to applied electrical signals, and said system comprising:

(a) a plurality of cavities, within a valve body, with each said cavity having distinct inlet ports, distinct outlet ports, and distinct chamber ports, each connected thereto;

(b) a rotatable control assembly, located largely within and extending between said cavities, and comprising, firstly, a central shaft dividing each said cavity into separate chambers, with each said chamber having at least one said inlet port, one said outlet port and one said chamber port and, secondly, radially projecting fins, coplanar with the axis of said shaft, extending therefrom into each said chamber, and intervening fully between said inlet and said outlet ports therein, so that, simultaneously, each is in the midrange between said inlet and said outlet ports therebeside when said assembly is positioned midway between rotative extremes;

(c) flow-impeding clearances, at least one being an inlet clearance between said fin and the adjacent wall surrounding said inlet port of said chamber, and at least one being an outlet clearance between said fin and the adjacent chamber wall surrounding said outlet port therebeside, each such said clearance forming within each said chamber when said control assembly is positioned intermediately between said rotative extremes;

(d) guiding means constraining rotational movement of said control assembly to be generally about the axis of said shaft, and thereby causing said rotation to change, within each said chamber, said inlet clearance in reciprocal proportion to said outlet clearance;

(e) means for rotating said control assembly, and thereby changing said clearances, in proportion to said electrical signals;

(f) means to conduct fluid, substantially unimpeded, between each said inlet port and a said supply port, and between each said outlet port and a said return port; further, discrete means to conduct fluid, either relatively impeded or substantially unimpeded, between each said chamber port and a said control port, with each said control port being thus connected to sufficient distinct said chamber ports to thereby utilize at least one said discrete means impeding flow and one said discrete means not impeding flow, but connected only to said chamber ports of said chambers in which rotation of said control assembly changes said inlet clearances equally therein, and, simultaneously, said outlet clearances equally therein;

(g) means causing the net hydrostatic torque acting on said control assembly, in the absence of any net unbalanced hydrodynamic torques acting on said assembly, to be generally small or nil;

(h) means causing the net hydrostatic torques acting on said control assembly, within said chambers having said chamber ports connected to the same said control port, to be similarly oriented; means causing the net hydrostatic torques acting on said control assembly in said chambers having said chamber ports connected to said control ports by said fluid-conductive means not impeding flow to be counterposed, and those in said chambers having said chamber ports connected to said control ports by said fluid-conductive means impeding flow to be counterposed; means causing the net hydrostatic torque acting on said control assembly in each said chamber to be directed to rotate said assembly toward said outlet port thereat, and away from said inlet port thereat;

(j) means causing the net hydrostatic torque acting on said control assembly in each said chamber having said chamber port connected to said control port by said fluid-conductive means not impeding flow, to vary in proportion to fluid pressure applied thereto via said chamber port thereat; means causing the net hydrostatic torque acting on said control assembly, in each said chamber having said chamber port connected to said control port by said fluid-conductive means impeding flow, to vary in inverse proportion to fluid pressure applied thereto via said chamber port thereat; and means ensuring that the magnitudes of the net hydrostatic torques acting on said control assembly, in said chambers having said chamber ports connected to said control ports by said fluid-conductive means impeding flow, are at least as sensitive to changes in fluid pressure applied thereto via said chamber port thereat, as are those in said chambers having said chamber ports connected to said control ports by said fluid-conductive means not impeding flow;

whereby, with equal fluid pressures delivered to said supply ports and with equal fluid pressures existing at said return ports, any unbalanced hydrodynamic torques acting to translate said control assembly are offset by proportional hydrostatic torques, thereby stabilizing said assembly between said inlet and said outlet ports, and enabling said system to control the flow delivered through said control ports, in response to said electrical signals, through changes in the relative positions of said fins within said chambers, by rotation of the thus stabilized said control assembly.

13. The system of claim 12 wherein said control assembly is mounted by resilient means which restrain said control assembly between said rotative extremes.

14. A balanced, pressure-compensated, single-stage hydraulic valve system with interconnected fluid-supply, interconnected fluid-return and distinct fluid-control ports, said hydraulic valve system being responsive to applied signals, and said system comprising:

(a) a plurality of cavities, with each said chamber having an inlet port, an outlet port, and a chamber port, each connected thereto;

(b) a displaceable control assembly, located largely within and extending between said cavities, and having substantially planar means, within each said chamber, with at least one said planar means intervening fully between said inlet port and said outlet port within each said chamber, so that simultaneously each said planar means is in the midrange between said inlet and said outlet ports therebeside when said assembly is positioned midway between displacive extremes;

(c) flow-impeding clearances, at least one being an inlet clearance between said planar means and the adjacent wall surrounding said inlet port of said chamber, and at least one being an outlet clearance between said planar means and the adjacent chamber wall surrounding said outlet port therebeside, each such said clearance forming within each said chamber when said control assembly is positioned intermediately between said rotative extremes;

(d) guiding means constraining displacive movement of said control assembly to be generally in the manner causing, within each said chamber, said inlet clearance to change in inverse proportion to said outlet clearance;

(e) means for displacing said control assembly, and thereby changing said clearances, in proportion to said signals;

(f) means to conduct fluid, substantially unimpeded, between each said inlet port and a said supply port, and between each said outlet port and a said return port; further, discrete means to conduct fluid between each said chamber port and a said control port, with each said control port being thus connected only to said chamber ports of said chambers in which displacement of said control assembly changes said inlet clearances similary therein, and, simultaneously, said outlet clearances similarly therein;

(g) means causing the net displacive hydrostatic force acting on said control assembly to be generally small or nil in the absence of unbalances displacive hydrodynamic forces acting likewise thereupon, and to be negligible or nil when unbalanced displacive hydrodynamic forces are absent and equal pressures exist in all said chambers;

(h) means counteracting any net unbalanced displacive hydrostatic force acting upon said control assembly;

whereby, with equal fluid pressures delivered to said supply ports and with equal fluid pressures existing at said return ports, any unbalanced hydrodynamic forces acting to displace said control assembly are compensated, thereby stabilizing said assembly between said inlet and said outlet ports, and enabling said system to control the flow delivered through said control ports, in response to said signals, through changes in the relative positions of said planar means within said chambers, by displacement of the thus stabilized said control assembly.

15. The system of claim 14 wherein said displacive movement of said control assembly is translative.

16. The system of claim 14 wherein said displacive movement of said control assembly is rotative.

17. The system of claim 14 wherein said means for displacing said control assembly includes a force motor.

18. The system of claim 14 wherein said signal is electrical.

19. The sysetm of claim 14 wherein means affecting the orientations and magnitudes of said hydrostatic forces acting on said control assembly in said chambers is proper sizing of the internal components, including said inlet and said outlet ports, said planar means, said inlet and said outlet clearances, and said fluid-conductive means impeding flow.

20. The system of claim 14 wherein said means counteracting net unbalanced hydrodynamic force comprises said net displacive hydrostatic force.

21. The system of claim 14 wherein said means counteracting net unbalanced hydrodynamic force comprises resilient means restraining said control assembly between said displacive extremes.

22. The system of claim 14 wherein each said discrete means to conduct fluid conducts fluid either relatively impeded or substantially unimpeded, and wherein each said control port is thereby connected to sufficient distinct said chamber ports to utilize at least one said discrete means impeding flow and one said discrete means not impeding flow.

23. The system of claim 22 wherein said said fluid-conductive means impeding flow includes an orifice.

24. The system of claim 14 having means to balance said control assembly against forces due to motion or orientation of said valve system.

25. The system of claim 14 wherein said inlet clearances are each formed between said planar means and a raised portion of said chamber wall surrounding said inlet port therebeside, and said outlet clearances are each formed between said planar means and a raised portion of said chamber wall surrounding said outlet port therebeside.

26. The system of claim 14 wherein said control assembly is slidably mounted.

27. The system of claim 14 wherein said planar means are simultaneously each approximately halfway between said inlet and outlet ports therebeside when said assembly is positioned midway between said displacive extremes.

28. The system of claim 14 having sealing means minimizing fluid leakage.

29. A balanced, pressure-flow-compensated, single-stage hydraulic valve system with interconnected fluid-supply, interconnected fluid-return and distinct fluid-control ports, said hydraulic valve system being responsive to applied electrical signals, and said system comprising:

(a) a plurality of spools, juxtaposed coaxially in a cavity within a valve body and separated thereby by spacing means therebetween, to form an even number of chambers, with said spacing means having means generally not impeding flow to conduct fluid radially therethrough, and with said chambers each interposed between the opening to an inlet bore, extending coaxially through one of the adjacent said spools therebeside, and the opening to an outlet bore, extending coaxially through the other adjacent said spool therebeside, and each having a chamber port, located between said adjacent spools in the wall of said cavity;

(b) a translatable control assembly extending between said chambers through said inlet bores and said outlet bores of said spools, said assembly comprising, firstly, a plurality of radially projecting flanges with at least one said flange intervening fully between said inlet bore and said outlet bore of each said chamber and, secondly, means to space apart said flanges so that, simultaneously, each is in the midrange between said adjacent spools therebeside when said assembly is positioned midway between translative extremes;

(c) flow-impeding clearances, at least one being an inlet clearance between said flange and the adjacent face surrounding said inlet bore of said adjacent spool, and at least one being an outlet clearance between said flange and the adjacent spool face surrounding said outlet bore therebeside, forming within each said chamber when said control assembly is positioned intermediately between said translative extremes;

(d) guiding means constraining translational movement of said control assembly to be generally codirectionally with the axis of said spools, and thereby causing said translation to change, within each said chamber, said inlet clearance in reciprocal proportion to said outlet clearance;

(e) means for translating said control assembly, and thereby changing said clearances, in proportion to said electrical signals;

(f) means to conduct fluid, substantially unimpeded, between each said inlet port and a said supply port, and between each said outlet port and a said return port; further, discrete means to conduct fluid, either relatively impeded or substantially unimpeded, between each said chamber port and a said control port, with each said control port being thus connected to sufficient distinct said chamber ports to thereby utilize at least one said discrete means impeding flow and one said discrete means not impeding flow, but connected only to said chamber ports of said chambers in which translation of said control assembly changes said inlet clearances equally therein, and, simultaneously, said outlet clearances equally therein;

(g) means causing the net hydrostatic force acting on said control assembly, in the absence of any net unbalanced axial hydrodynamic forces acting on said assembly, to be generally small or nil;

(h) means causing the net axial hydrostatic forces acting on said control assembly, within said chambers having said chamber ports connected to the same said control port, to be similarly oriented; means causing the net axial hydrostatic forces acting on said control assembly in said chambers having said chamber ports connected to said control ports by said fluid-conductive means not impeding flow to be counterposed, and those in said chambers having said chamber ports connected to said control ports by said fluid-conductive means impeding flow to be counterposed; means causing the net axial hydrostatic force acting on said control assembly in each said chamber to be directed toward said outlet bore thereat, and away from said inlet bore thereat;

(j) means causing the net axial hydrostatic force acting on said control assembly in each said chamber having said chamber port connected to said control port by said fluid-conductive means not impeding flow, to vary in proportion to fluid pressure applied thereto via said chamber port thereat; means causing the net axial hydrostatic force acting on said control assembly, in each said chamber having said chamber port connected to said control port by said fluid-conductive means impeding flow, generally to vary in inverse proportion to fluid pressure applied thereto via said chamber port thereat; and means generally ensuring that the magnitudes of the net axial hydrostatic forces acting on said control assembly, in said chambers having said chamber ports connected to said control ports by said fluid-conductive means impeding flow, are at least as sensitive to changes in fluid pressure applied thereto via said chamber port thereat, as are those in said chambers having said chamber ports connected to said control ports by said fluid-conductive means not impeding flow;

(k) means compensating any remaining net unbalanced hydrodynamic force acting upon said control assembly;

whereby, with equal fluid pressures delivered to said supply ports and with equal fluid pressures existing at said return ports, any unbalanced hydrodynamic forces acting to translate said control assembly are offset by proportional axial forces which comprise, in whole or in part, hydrostatic forces, thereby stabilizing said assembly between said spools, and enabling said system to control the flow delivered through said control ports, in response to said electrical signals, through changes in the relative position of the thus stabilized said control assembly.

30. The system of claim 29 wherein said means for translating said control assembly includes a force motor.

31. The system of claim 29 wherein means affecting the orientations and magnitudes of said hydrostatic forces acting on said control assembly in said chmabers is proper sizing of the internal components, including said inlet and said outlet bores, said flanges, said inlet and said outlet clearances, and said fluid-conductive means impeding flow.

32. The system of claim 29 wherein each said discrete fluid-conductive means impeding flow includes an orifice.

33. The system of claim 29 wherein said means for compensating any remaining unbalanced hydrodynamic forces includes resilient means restraining said control assembly between said translative extremes.

34. The system of claim 29 having means to balance said control assembly against forces created by motion or orientation of said valve system.

35. The system of claim 29 wherein said clearances are each formed between said flange and a raised annular portion of said surface of said spool surrounding said opening to said inlet or said outlet bore therebeside.

36. The system of claim 29 wherein said internal components are substantially symmetrical on either side of the midplane normal to the axis of the middlemost said spool.

37. The system of claim 29 wherein said control assembly is slidably mounted.

38. The system of claim 29 wherein said flanges are simultaneously each approximately halfway between said adjacent faces of said spools therebeside when said assembly is positioned midway between said extremes.

39. The system of claim 29 having sealing means minimizing fluid leakage.

40. A balanced, pressure-flow-compensated, single-stage hydraulic valve system with interconnected fluid-supply, interconnected fluid-return and distinct fluid-control ports, said hydraulic valve system being responsive to applied electrical signals, and said system comprising:

(a) a plurality of cavities, within a valve body, with each said cavity having distinct inlet portions, distinct outlet ports, and distinct chamber ports, each connected thereto;

(b) a rotatable control assembly, located largely within and extending between said cavities, and comprising, firstly, a central shaft dividing each said cavity into separate chambers, with each chamber having at least one said inlet port, one said outlet port and one said chamber port and, secondly, radially projecting fins, coplanar with the axis of said shaft, extending therefrom into each said chamber, and intervening fully between said inlet and said outlet ports therein, so that, simultaneously, each is in the midrange between said inlet and said outlet ports therebeside when said assembly is positioned midway between rotative extremes;

(c) flow-impeding clearances, at least one being an inlet clearance between said fin and the adjacent wall surrounding said inlet port of said chamber, and at least one being an outlet clearance between said fin and the adjacent chamber wall surrounding said outlet port therebeside, each such said clearance forming within each said chamber when said control assembly is positioned intermediately between said rotative extremes;

(d) guiding means constraining rotational movement of said control assembly to be generally about the axis of said shaft, and thereby causing said rotation to change, within each said chamber, said inlet clearance in reciprocal proportion to said outlet clearance;

(e) means for rotating said control assembly, and thereby changing said clearances, in proportion to said electrical signals;

(f) means to conduct fluid, substantially unimpeded, between each said inlet port and a said supply port, and between each said outlet port and a said return port; further, discrete means to conduct fluid, either relatively impeded or substantially unimpeded, between each said chamber port and a said control port, with each said control port being thus connected to sufficient distinct said chamber ports to thereby utilize at least one said discrete means impeding flow and one said discrete means not impeding flow, but connected only to said chamber ports of said chambers in which translation of said control assembly changes said inlet clearances equally therein, and, simultaneously, said outlet clearances equally therein;

(g) means causing the net hydrostatic torque acting on said control assembly, in the absence of any net unbalanced hydrodynamic torques acting on said assembly, to be generally small or nil;

(h) means causing the net hydrostatic torque acting on said control assembly, within said chambers having said chamber ports connected to the same said control port to be similarly oriented; means causing the net hydrostatic torques acting on said control assembly in said chambers having said chamber ports connected to said control ports by said fluid-conductive means not impeding flow to be counterposed, and those in said chambers having said chamber ports connected to said control ports by said fluid-conductive means impeding flow to be counterposed; means causing the net hydrostatic torque acting on said control assembly in each said chamber to be directed to rotate said assembly toward said outlet port thereat, and away from said inlet port thereat;

(j) means causing the net hydrostatic torque acting on said control assembly in each said chamber having said chamber port connected to said control port by said fluid-conductive means not impeding flow, to vary in proportion to fluid pressure applied thereto via said chamber port thereat; means causing the net hydrostatic torque acting on said control assembly, in each said chamber having said chamber port connected to said control port by said fluid-conductive means impeding flow, generally to vary in inverse proportion to fluid pressure applied thereto via said chamber port thereat; and means generally ensuring that the magnitudes of the net hydrostatic torques acting on said control assembly, in said chambers having said chamber ports connected to said control ports by said fluid-conductive means impeding flow, are at least as sensitive to changes in fluid pressure applied thereto via said chamber port thereat, as are those in said chambers having said chamber ports connected to said control ports by said fluid-conductive means not impeding flow;

(k) means compensating any remaining net unbalanced hydrodynamic torque acting upon said control assembly;

whereby, with equal fluid pressures delivered to said supply ports and with equal fluid pressures existing at said return ports, any unbalanced hydrodynamic torques acting to translate said control assembly are offset by proportional torques which comprise, in whole or in part, hydrostatic torques, thereby stabilizing said assembly between said inlet and said outlet ports, and enabling said system to control the flow delivered through said control ports, in response to said electrical signals, through changes in the relative positions of said fins within said chambers, by rotation of the thus stabilized said control assembly.

41. The system of claim 40 wherein said means for rotating said control assembly includes a force motor.

42. The system of claim 40 wherein means affecting the orientations and magnitudes of said hydrostatic forces acting on said control assembly in said chambers is proper sizing of the internal components, including said inlet and said outlet ports, said fins, said inlet and said outlet clearances, and said fluid-conductive means impeding flow.

43. The system of claim 40 wherein each said discrete fluid-conductive means impeding flow includes an orifice.

44. The system of claim 40 wherein said means for compensating any remaining unbalanced hydrodynamic forces includes resilient means restraining said control assembly between said rotative extremes.

45. The system of claim 40 wherein said control assembly is slidably mounted.

46. The system of claim 40 wherein said fins are simultaneously each approximately halfway between said inlet and outlet ports therebeside when said assembly is positioned midway between said rotative extremes.

47. The system of claim 40 having sealing means minimizing fluid leakage.

* * * * *

UNITED STATES PATENT AND TRADEMARK OFFICE

CERTIFICATE OF CORRECTION

PATENT NO. : 5,133,386

DATED : July 28, 1992

INVENTOR(S) : Garth L. Magee

It is certified that error appears in the above-indentified patent and that said Letters Patent is hereby corrected as shown below:

Column 6, line 34, change '(2)central' to —(2)—.

Column 6, line 35, change 'inlet' to —central inlet—.

Column 6, line 46, change 'are shown' to —are shown—.

Column 7, line 30, change '90' to —91—.

Column 7, line 31, change '91' to —92—.

Column 7, line 32, change '92' to —93—.

Column 7, line 33, change '93' to —94—.

Column 7, line 34, change '94' to —95—.

Column 7, line 35, change '95' to —96—.

Column 7, line 36, change '96' to —97—.

Column 7, line 37, change '97' to —98—.

Column 7, line 38, change '98' to —99—.

Column 7, delete line 39,

Column 7, line 57, change 'singular' to —singular inlet port—.

Column 7, line 68, change 'compressive' to —compressible—.

Column 11, line 24, change 'predominate' to —predominate.—.

Column 15, line 11, change 'their while' to —their common control port 44. In order to meet the third constraint while—.

Column 19, line 59, change 'locations 27' to —locations of 27—.

Column 20, line 3, change 'springs 103' to —springs 102—.

Column 20, line 51, change 'into' to —onto—.

Column 21, line 28, change 'wuold' to —would—.

UNITED STATES PATENT AND TRADEMARK OFFICE

CERTIFICATE OF CORRECTION

PATENT NO. : 5,133,386

DATED : July 28, 1992

INVENTOR(S) : Garth L. Magee

It is certified that error appears in the above-indentified patent and that said Letters Patent is hereby corrected as shown below:

Column 26, line 38, change 'translate' to —rotate—.

Column 26, line 49, change 'pressure-compensated' to —pressure-flow-compensated—.

Column 26, line 54, change 'cavities' to —chambers—.

Column 26, line 58, change 'cavities,' to —chambers,—.

Column 27, line 7, change 'rotative' to —displacive—.

Column 27, line 29, change 'unbalances' to —unbalanced—.

Column 28, line 38, change 'thereby' to —therein—.

Column 29, lines 4 through 5 change 'codirectionally' to —codirectional—.

Column 29, line 13, change 'inlet port' to —inlet bore—.

Column 29, line 14, change 'outlet port' to —outlet bore—.

Column 29, line 51, change 'flow, to' to —flow, generally to—.

Column 30, line 58, change 'portions' to —ports—.

Column 30, line 65, change 'chamber' to —said chamber—.

Column 31, line 36, change 'translation' to —rotation—.

Column 31, line 44, change 'torque' to —torques—.

Column 31, line 47, change 'port to' to —port, to—.

UNITED STATES PATENT AND TRADEMARK OFFICE

CERTIFICATE OF CORRECTION

PATENT NO. : 5,133,386

DATED : July 28, 1992

INVENTOR(S) : Garth L. Magee

It is certified that error appears in the above-indentified patent and that said Letters Patent is hereby corrected as shown below:

Column 32, line 3, change 'to vary' to —generally to vary—.

Column 32, line 27, change 'translate' to —rotate—.

Signed and Sealed this

Twelfth Day of October, 1993

*Attest:*

*Attesting Officer*

BRUCE LEHMAN

*Commissioner of Patents and Trademarks*